US011072052B2

(12) United States Patent
Aiken et al.

(10) Patent No.: US 11,072,052 B2
(45) Date of Patent: Jul. 27, 2021

(54) GUARD ASSEMBLY FOR A POWER TOOL

(71) Applicant: Black & Decker Inc., New Britain, CT (US)

(72) Inventors: Joshua J. Aiken, Eldersburg, MD (US); Qingyang Li, Suzhou (CN); Peter Chaikowsky, Forest Hill, MD (US); Sean M. Kelly, York, PA (US); Yaping Yang, Suzhou (CN)

(73) Assignee: Black & Decker Inc., New Britain, CT (US)

( * ) Notice: Subject to any disclaimer, the term of this patent is extended or adjusted under 35 U.S.C. 154(b) by 0 days.

(21) Appl. No.: 15/095,268

(22) Filed: Apr. 11, 2016

(65) Prior Publication Data

US 2016/0297051 A1 Oct. 13, 2016

Related U.S. Application Data

(60) Provisional application No. 62/146,576, filed on Apr. 13, 2015.

(51) Int. Cl.

| | |
|---|---|
| ***B24B 23/02*** | (2006.01) |
| ***B24B 55/05*** | (2006.01) |
| ***B24B 55/04*** | (2006.01) |
| ***B27G 19/04*** | (2006.01) |

(52) U.S. Cl.

CPC ..... *B24B 55/052* (2013.01); *B24B 23/028* (2013.01); *B24B 55/04* (2013.01); *B27G 19/04* (2013.01)

(58) Field of Classification Search

CPC ..... B24B 55/052; B24B 23/028; B24B 55/04; B24B 55/05; B24B 55/045; B27G 19/04

See application file for complete search history.

(56) References Cited

U.S. PATENT DOCUMENTS

| | | | |
|---|---|---|---|
| 3,805,639 | A | 4/1794 | Peter |
| 2,741,282 | A | 4/1956 | Wieting |
| 2,926,709 | A | 3/1960 | Kaley |
| 3,585,980 | A | 6/1971 | Mellor |

(Continued)

FOREIGN PATENT DOCUMENTS

| | | |
|---|---|---|
| CN | 102632459 | 8/2012 |
| CN | 104369109 | 2/2015 |

(Continued)

OTHER PUBLICATIONS

Extended EP Search Reported dated Oct. 6, 2016 issued in corresponding EP application No. 16164731.8.

(Continued)

*Primary Examiner* — Orlando E Aviles

*Assistant Examiner* — Joel D Crandall

(74) *Attorney, Agent, or Firm* — Amir R. Rohani

(57) ABSTRACT

A guard assembly for an abrasive accessory of a power tool is provided, including a guard shell being associated with a first surface of the abrasive accessory and secured to the power tool around an output spindle of the power tool; and a guard cover being associated with a second surface of the abrasive accessory opposite the first surface and attached to the guard shell at a pivot point having an axis that is at a distance from an axis of the spindle, the guard cover being rotatably movable with respect to the guard shell around the pivot point.

22 Claims, 21 Drawing Sheets

(56) References Cited

U.S. PATENT DOCUMENTS

| | | | | |
|---|---|---|---|---|
| 3,613,748 | A | 10/1971 | De Pue | |
| 3,695,249 | A | 10/1972 | Swenson | |
| 4,972,589 | A | 11/1990 | Povleski | |
| 5,012,582 | A | 5/1991 | Bristol et al. | |
| 5,862,594 | A * | 1/1999 | Soderqvist | B23Q 11/06 30/122 |
| 5,893,311 | A | 4/1999 | Huang | |
| 5,950,514 | A | 9/1999 | Benedict et al. | |
| 5,974,674 | A | 11/1999 | Kelly | |
| 6,048,260 | A | 4/2000 | Kopras | |
| D425,898 | S | 5/2000 | Iwaasa et al. | |
| 6,588,111 | B2 | 7/2003 | Williams | |
| 6,878,050 | B2 | 4/2005 | Wendt et al. | |
| 6,953,394 | B2 | 10/2005 | Wendt et al. | |
| 7,223,163 | B2 | 5/2007 | Neumeier et al. | |
| 7,300,339 | B2 | 11/2007 | Gaul et al. | |
| 7,628,683 | B2 | 12/2009 | Hoffmann et al. | |
| 7,980,924 | B2 | 7/2011 | Blatz | |
| 8,939,816 | B2 | 1/2015 | Chen | |
| 2002/0151262 | A1 * | 10/2002 | Berger | B24B 23/028 451/358 |
| 2005/0217124 | A1 | 10/2005 | Fuchs et al. | |
| 2006/0067798 | A1 * | 3/2006 | Neumeier | B23Q 11/06 407/66 |
| 2007/0093189 | A1 * | 4/2007 | Gaul | B24B 55/052 451/451 |
| 2008/0168667 | A1 | 7/2008 | Spinato | |
| 2009/0036043 | A1 * | 2/2009 | Blatz | B24B 55/052 451/451 |
| 2009/0100885 | A1 | 4/2009 | Boeck et al. | |
| 2010/0275755 | A1 | 11/2010 | Cox | |
| 2011/0079207 | A1 | 4/2011 | Guth | |
| 2013/0283622 | A1 | 10/2013 | Eto et al. | |
| 2014/0342645 | A1 | 11/2014 | Tagscherer | |

FOREIGN PATENT DOCUMENTS

| | | | | |
|---|---|---|---|---|
| DE | 2331086 | | 1/1975 | |
| DE | 29707664 | | 7/1997 | |
| DE | 102004035876 | B3 * | 12/2005 | B24B 55/052 |
| EP | 2452771 | | 5/2012 | |
| EP | 2591898 | | 5/2013 | |
| EP | 2599601 | | 6/2013 | |
| EP | 2684632 | | 1/2014 | |
| FR | 2493740 | | 5/1982 | |
| JP | H07276302 | | 10/1995 | |
| JP | 2000033514 | A * | 2/2000 | B24B 55/052 |
| JP | 2008307643 | | 12/2008 | |
| JP | 4953038 | B1 * | 6/2012 | B26B 25/002 |
| WO | 2012024539 | | 2/2012 | |

OTHER PUBLICATIONS

Extended EP Search Report dated Oct. 12, 2016 issued in corresponding EP application No. 16164733.4.
EP Office Action dated Dec. 5, 2017 issued in corresponding EP application No. 16164731.8.
EP Office Action dated Dec. 6, 2017 issued in corresponding EP application No. 16164733.4.
NFOA dated Sep. 7, 2017 issued in corresponding U.S. Appl. No. 15/095,275.
Non-Final Office Action, dated Sep. 7, 2017 in related U.S. Appl. No. 15/095,275.
Final Office Action, dated Jun. 20, 2018 in related U.S. Appl. No. 15/095,275.

* cited by examiner

GUARD ASSEMBLY FOR A POWER TOOL

CROSS-REFERENCE TO RELATED APPLICATION

This application claims the benefit of U.S. Provisional Application No. 62/146,576 titled "Guard Assembly for Angle Grinder," filed Apr. 13, 2015, content of which is incorporated herein by reference in its entirety.

FIELD

This application relates to a guard assembly for a power tool, and in particular a guard assembly for an abrasive accessory of an angle grinder.

BACKGROUND

Angle grinders may be used for various grinding and cutting operations. Various types of grinding or cutting wheels can be used and mounted on the grinder spindle. Grinding wheel guards, such as type-27 guards, are provided for grinding operations and cover approximately 180 degrees of the wheel periphery, but leave the outer surface of the wheel substantially exposed. This allows the grinding wheel to be mounted onto the tool spindle rather easily. Conventional cutting wheel guards, such as type-1 guards provided for cutting operations, cover approximately 180 degrees of the wheel periphery and approximately half of each both surfaces of the wheel. This arrangement is needed b/c cutting wheels are more likely to break, fly off the spindle, or shatter during a cutting operation. Conventional cutting guards are thick enough to allow the user to insert the wheel inside the guard at an angle and mount the wheel onto the grinder spindle. However, such cutting guards block a substantial part of the user's field of vision over the work piece.

Typically available angle grinder guards cover or enclose approximately 180 degrees of the wheel perimeter regardless of the application they are used for. Certain applications may only require the use of a small portion of the cutting wheel to be used and exposed. Particularly, in some applications the wheel may be more prone to a burst or a kickback event. Leaving 180 degrees of the wheel exposes increases the risk to the user in such applications.

SUMMARY

According to an embodiment of the invention, a guard assembly for an abrasive accessory of a power tool is provided. The guard assembly includes a guard shell being associated with a first surface of the abrasive accessory and secured to the power tool around an output spindle of the power tool; and a guard cover being associated with a second surface of the abrasive accessory opposite the first surface and attached to the guard shell at a pivot point having an axis that is at a distance from an axis of the spindle, the guard cover being rotatably movable with respect to the guard shell around the pivot point.

In an embodiment, the guard shell includes a guard collar configured to lock around a tool collar of the power tool located around the output spindle of the power tool.

In an embodiment, the pivot point includes a rivet rotatably attaching the guard cover to the guard shell, the rivet being located near an outer periphery of the inner guard shell.

In an embodiment, the guard cover is rotatable with respect to the guard shell between a closed position, where the guard cover covers approximately half or more of the second surface of the abrasive accessory, and an open position, where the guard cover covers less than approximately half of the second surface of the abrasive accessory.

In an embodiment, the guard assembly includes a spring member arranged to bias the guard cover into at least one of the close position or the open position with respect to the guard shell.

In an embodiment, the guard assembly includes a pivot stop arranged near the pivot point to limit a rotational movement of the guard cover with respect to the guard shell around the pivot point in the open position.

In an embodiment, the guard assembly includes a latch assembly arranged to secure the guard cover to the guard shell in the closed position.

In an embodiment, the latch assembly includes a latch coupled to the guard cover and actuated via an actuator member, and a corresponding slot in the guard shell engageable by the latch.

In an embodiment, the latch assembly includes a spring arranged to bias the latch into engagement into the slot of the guard shell.

In an embodiment, the guard shell includes a semi-disc-shaped surface facing a portion of the first surface of the abrasive accessory and the peripheral portion covering a peripheral portion of the abrasive accessory.

In an embodiment, the guard cover includes a semi-disc-shaped surface facing a portion of the second surface of the abrasive accessory in the closed position.

In an embodiment, a thickness of the guard assembly as defined between outer surfaces of the guard shell and guard cover is less than or equal to approximately 25 mm.

According to an embodiment of the invention, a power tool is provided including an output spindle driven by an electric motor; and a guard assembly as described above.

In an embodiment, the power tool includes a field case housing the electric motor and having an motor spindle; and a gear case attached to an end of the field case and housing a gearset driven by the motor spindle, the gearset supporting the output spindle to rotate with the motor spindle.

In an embodiment, the power tool includes at least one of a small angle grinder, a large angle grinder, or a saw.

According to another embodiment of the invention, a guard assembly for an abrasive accessory of a power tool is provided, including: an inner guard secured to the power tool around an output spindle of the power tool; and an outer guard secured to the inner guard at a pivot point along or in close proximity to an axis of the spindle, the outer guard being rotatably movable with respect to the inner guar around the pivot point between a retracted position, where the inner and outer guards together cover a first angular area of the abrasive accessory, and an extended position, where the inner and outer guards together cover a second angular area of the abrasive accessory larger than the first angular area.

In an embodiment, the inner guard covers approximately half or more of both surfaces of the abrasive accessory and the outer guard covers less than half of both surfaces of the inner guard in the retracted position.

In an embodiment, the outer guard is slidably positioned on the inner guard so that the inner and outer guards together cover up to approximately 270 degrees of a peripheral area of the abrasive accessory in the extended position.

In an embodiment, the pivot point includes a rivet rotatably connecting a side surface of the inner guard to a side surface of the outer guard.

In an embodiment, the inner guard includes a guard collar configured to lock around a tool collar of the power tool located around the output spindle of the power tool.

In an embodiment, the outer guard includes a first stop member projected radially inwardly towards a center of the guard assembly and the guard collar comprises a second stop member projecting radially outwardly towards the outer guard to engage the first stop member in the extended position.

In an embodiment, the guard assembly includes a lock assembly configured to secure an angular position of the outer guard with respect to the inner guard.

In an embodiment, the lock assembly is disposed on an outer periphery of the outer guard.

In an embodiment, the lock assembly includes an actuation member actuable by a user and an engagement portion extending from the actuation member around a pivot member secured to the outer guard.

In an embodiment, the inner guard includes peripheral slots engageable by the engagement member.

In an embodiment, one of the inner guard or the outer guard includes at least one guide member and the other one of the outer guard or the inner guard comprises an arcuate channel arranged to slidably received the at least one guide member therein, and the guide member travels through the channel as the outer guard is rotated with respect to the inner guard. In an embodiment, the ends of the arcuate channel provide stops for the guide member in the retracted and extended positions.

In an embodiment, the inner guard includes a guard shell associated with a first surface of the abrasive accessory and secured to the power tool around an output spindle of the power tool; and a guard cover being associated with a second surface of the abrasive accessory opposite the first surface and attached to the guard shell at a pivot point having an axis that is at a distance from an axis of the spindle, the guard cover being rotatably movable with respect to the guard shell around the pivot point.

In an embodiment, the outer guard is secured to the guard cover.

According to an embodiment, a power tool is provided including an output spindle driven by an electric motor; and a guard assembly as described above.

In an embodiment, the power tool includes a field case housing the electric motor and having an motor spindle; and a gear case attached to an end of the field case and housing a gearset driven by the motor spindle, the gearset supporting the output spindle to rotate with the motor spindle.

In an embodiment, the power tool includes at least one of a small angle grinder, a large angle grinder, or a saw.

BRIEF DESCRIPTION OF THE DRAWINGS

In the accompanying drawings which form part of the specification.

Corresponding reference numerals indicate corresponding parts throughout the several figures of the drawings.

DESCRIPTION

Figure 1:
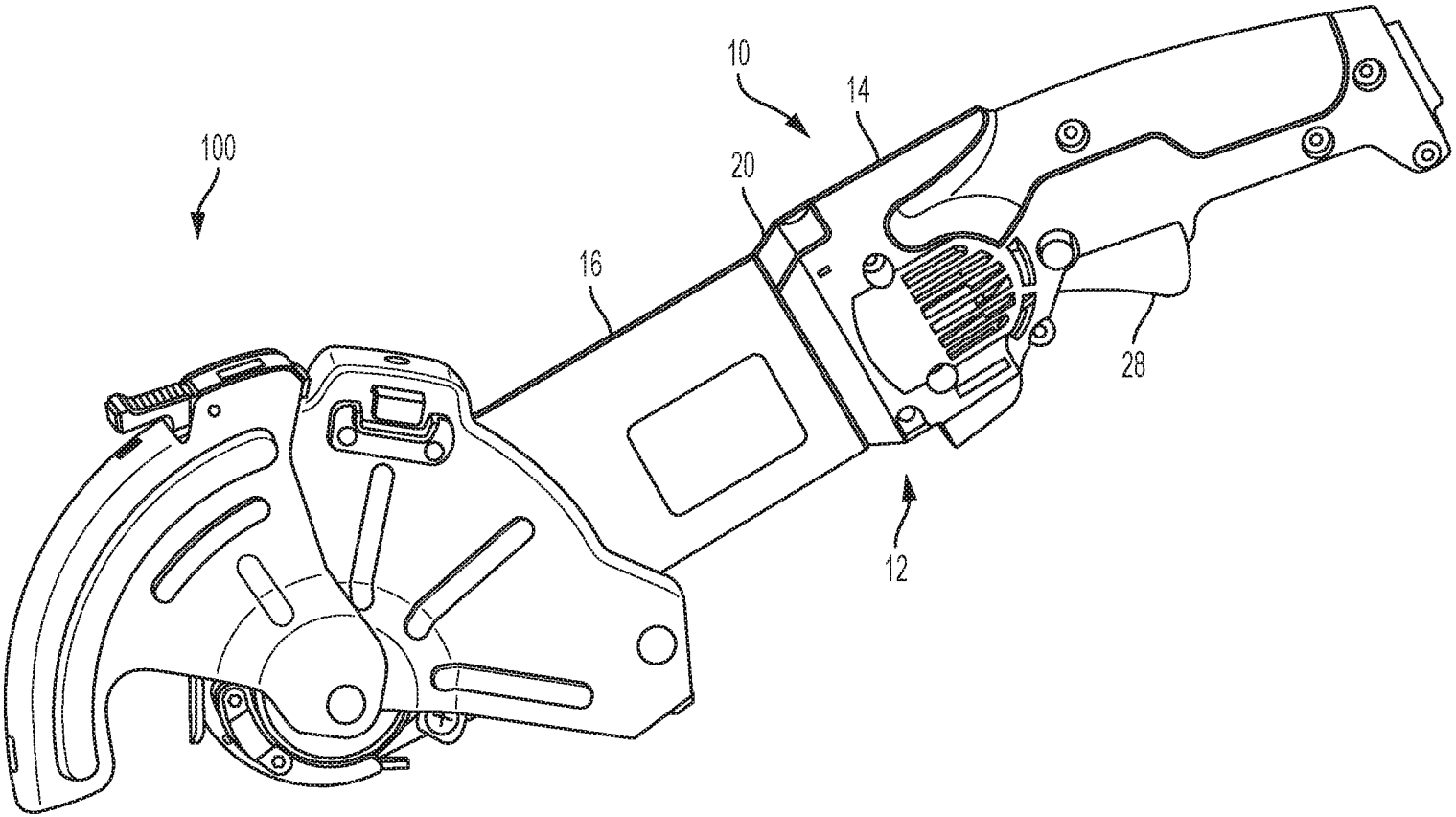
FIG. 1 depicts a view of an angle grinder having a guard assembly, according to an embodiment.

The following description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

Figure 2:
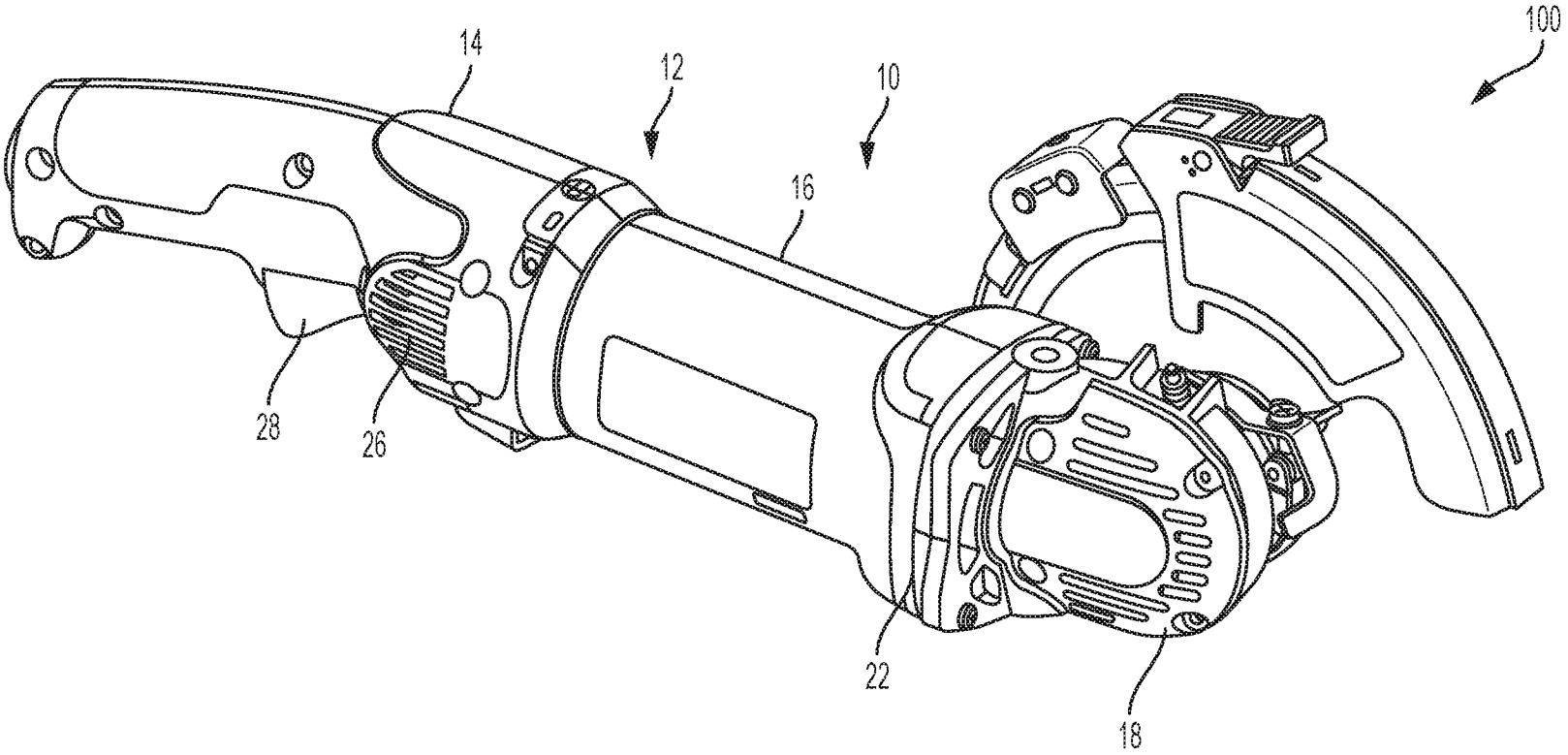
FIG. 2 depicts another perspective view of the angle grinder and the guard assembly, according to an embodiment.
Figure 3:
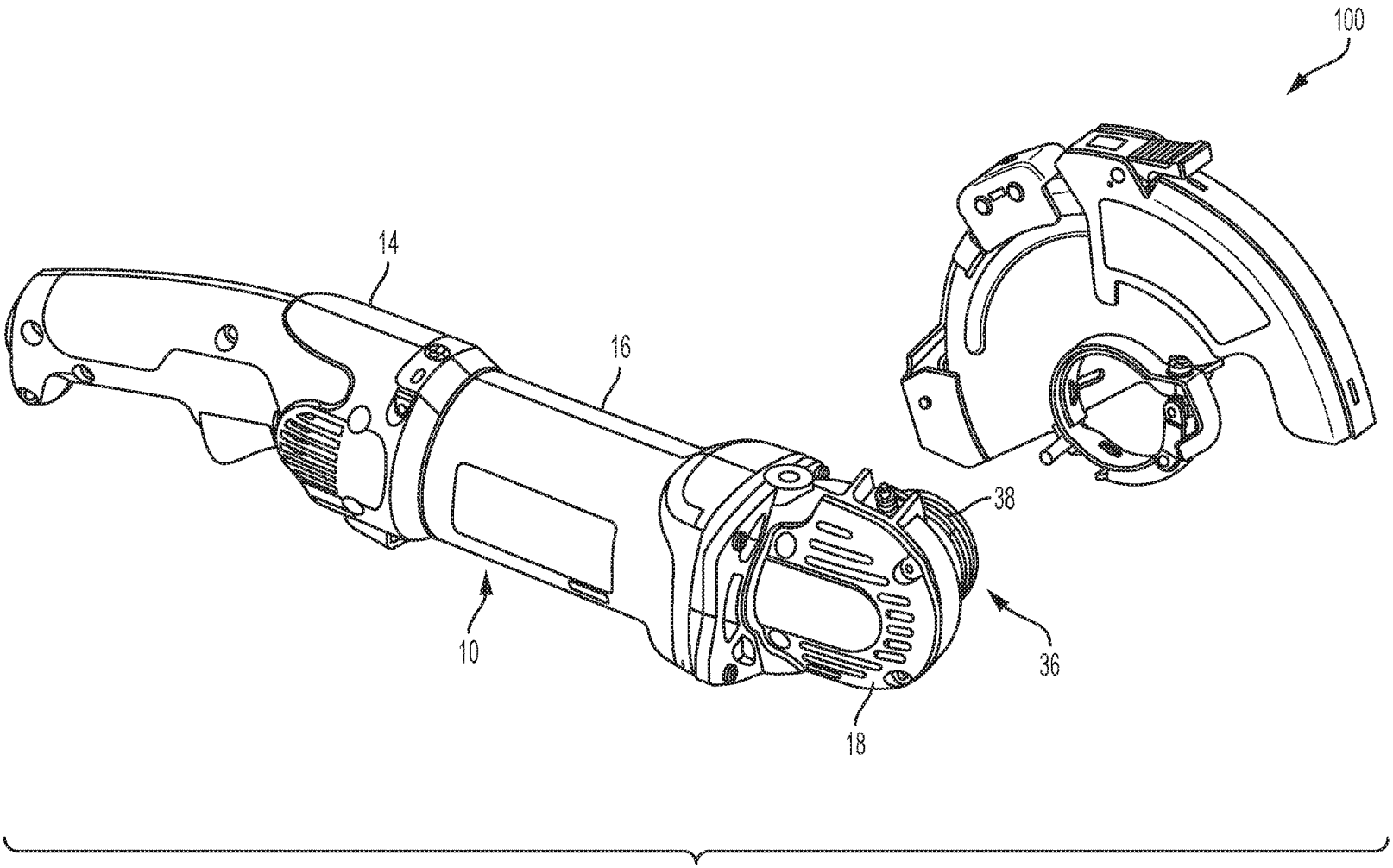
FIG. 3 depicts a perspective view of the angle grinder with the guard assembly detached, according to an embodiment.
Figure 4:
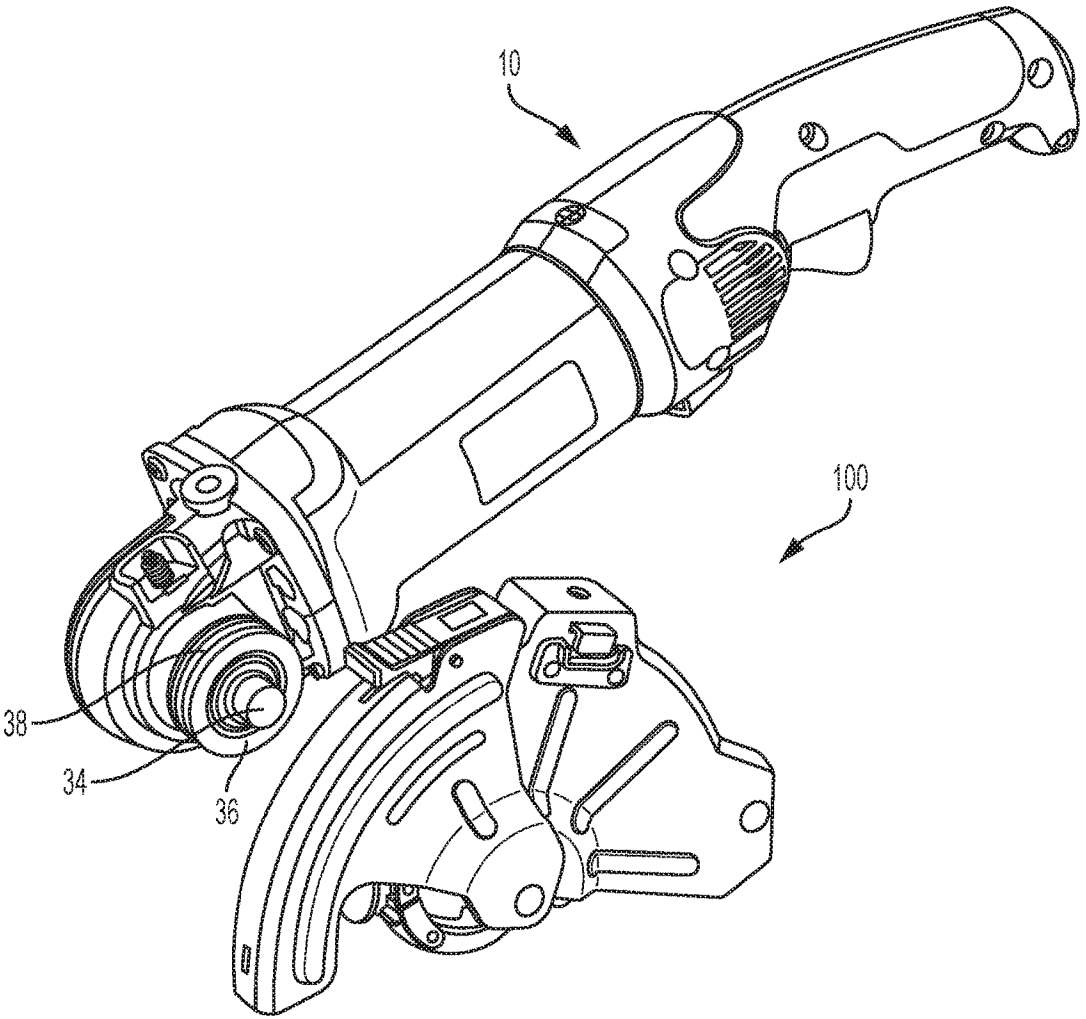
FIG. 4 depicts another perspective view of the angle grinder with the guard assembly detached, according to an embodiment.

FIGS. 1 and 2 depict front and back views of an angle grinder 10 having a guard assembly 100, according to an embodiment. FIGS. 3 and 4 depict front and back views of the same angle grinder 10 with the guard assembly 100 detached. It is initially noted that while the described exemplary embodiments are made with reference to a shell guard for a small angle grinder, it will be readily appreciated that the shell guard of this disclosure may be utilized for any power tool having an abrasive accessory, grinding disc, or cutting disc, including a large angle grinder, a saw, etc.

In an embodiment, angle grinder 10 includes a housing 12 having a handle portion 14, a field case 16, and a gear case 18. The handle portion 14 in an embodiment is fixedly attached to a first end 20 of the field case 16 and the gear case 18 is fixedly attached to a second end 22 of the field case 16. The handle portion 14 in an embodiment supports a power switch (not shown) and associated components arranged to supply power from a power source (e.g., a power cord, now shown, attached to the end of the handle portion 14) to a motor (not shown, disposed within the field case 16). The power switch, in an embodiment, is coupled to a trigger switch 28. The handle portion 14 may also support a particle separation assembly (now shown) that separates dust particles and contamination out of outlets 26. The motor includes a motor spindle (not shown) that extends into the gear case 18 for driving a gearset supported therein. In an embodiment, a wheel spindle 34 extends from gear case and is rotatably driven by the motor spindle through the gearset. The axis of rotation of motor spindle is generally perpendicular to the axis of rotation of the wheel spindle 34. A grinder wheel (not shown) is preferably selectively attachable to the wheel spindle 34 and is rotatably driven thereby.

In an embodiment, gear case 18 includes a tool collar (or neck) 36 disposed around the wheel spindle 34. The tool collar 36 provides a mounting platform for securely receiving the guard assembly 100. The wheel spindle 34 rotatably extends through the tool collar 36. The tool collar 36 may include, in an embodiment, an annular track (or groove) 38 extending about its circumference. As explained below, the annular track 38 is used for locking a locking element of the guard assembly 100 around the tool collar 36.

A first aspect of the invention is described herein with reference to FIGS. 5-15. According to this aspect of the invention, the guard assembly 100 includes a guard shell that is secured to the tool collar 36, discussed above, and a guard cover that is pivotable around a rivet with respect to guard shell to substantially expose an outer face of the abrasive disc. The arrangement of the guard shell with the pivoting guard cover (hereinafter also referred to as "inner guard shell" and "inner guard cover") allows the user to install or remove the abrasive disc easily without interference from the guard cover.

Figure 5:
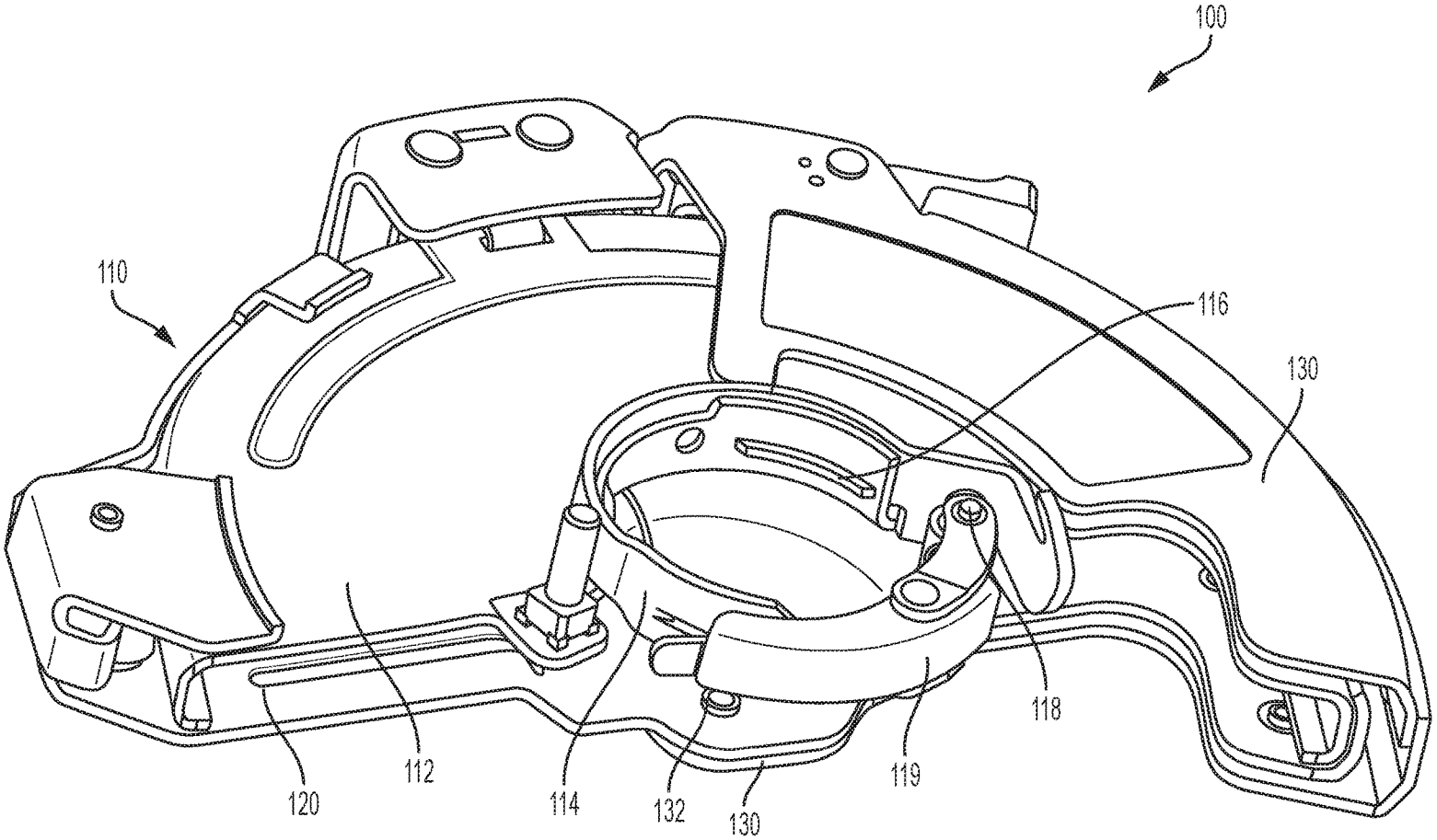
FIG. 5 depicts a perspective view of the guard assembly in a closed position, according to an embodiment.
Figure 6:
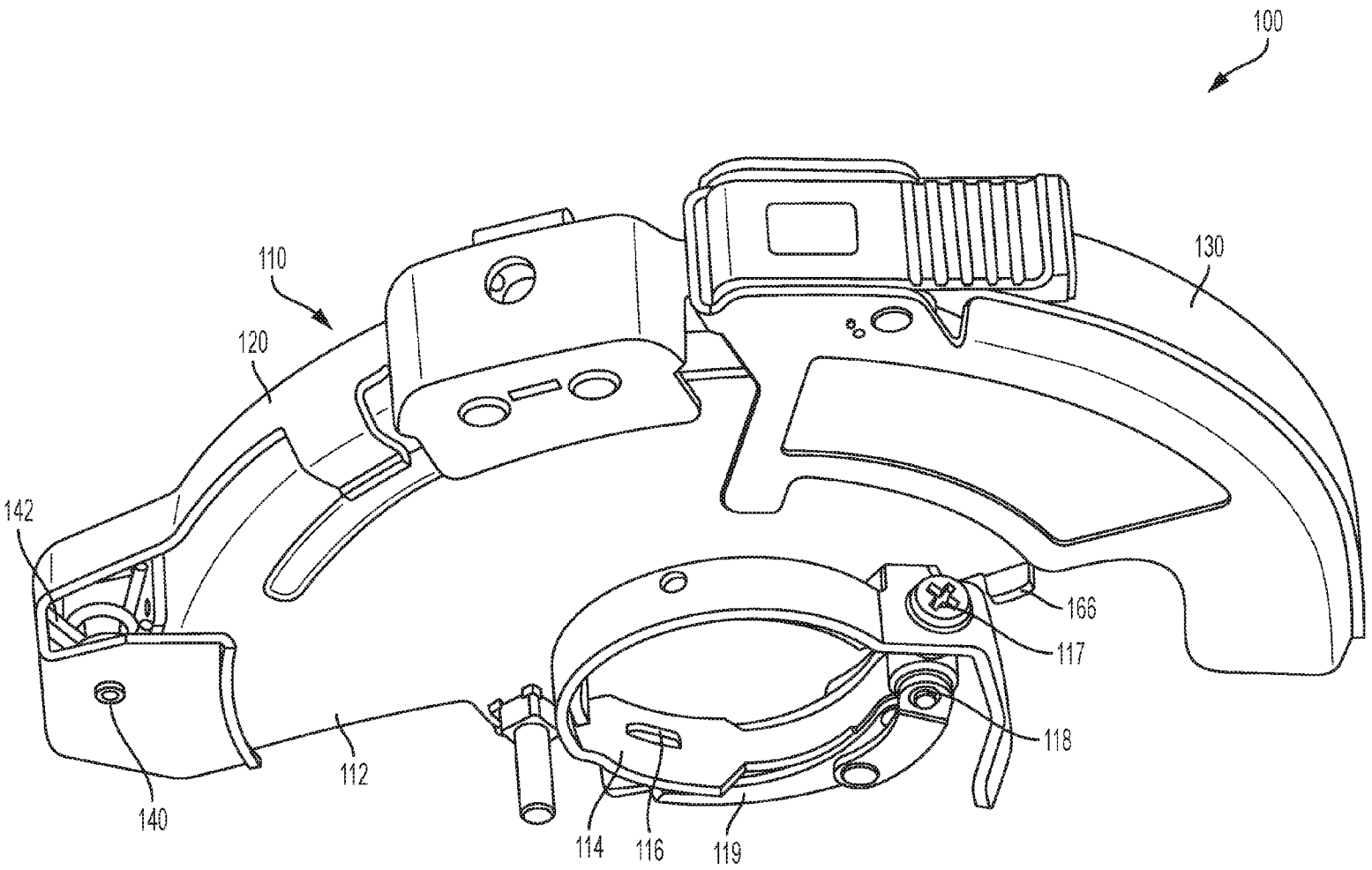
FIG. 6 depicts top perspective view of the guard assembly in closed position, according to an embodiment.

Referring to FIGS. 5 and 6, guard assembly 100 includes an inner guard 110 and an outer guard 130, according to an embodiment. Inner guard 110 includes an inner guard shell 112 and an inner guard cover 120, in an embodiment. The inner guard 110 in these figures is depicted in the "closed" position, wherein the inner guard cover 120 securely mates with and covers an outer periphery of the inner guard shell 112, according to an embodiment.

Figure 7:
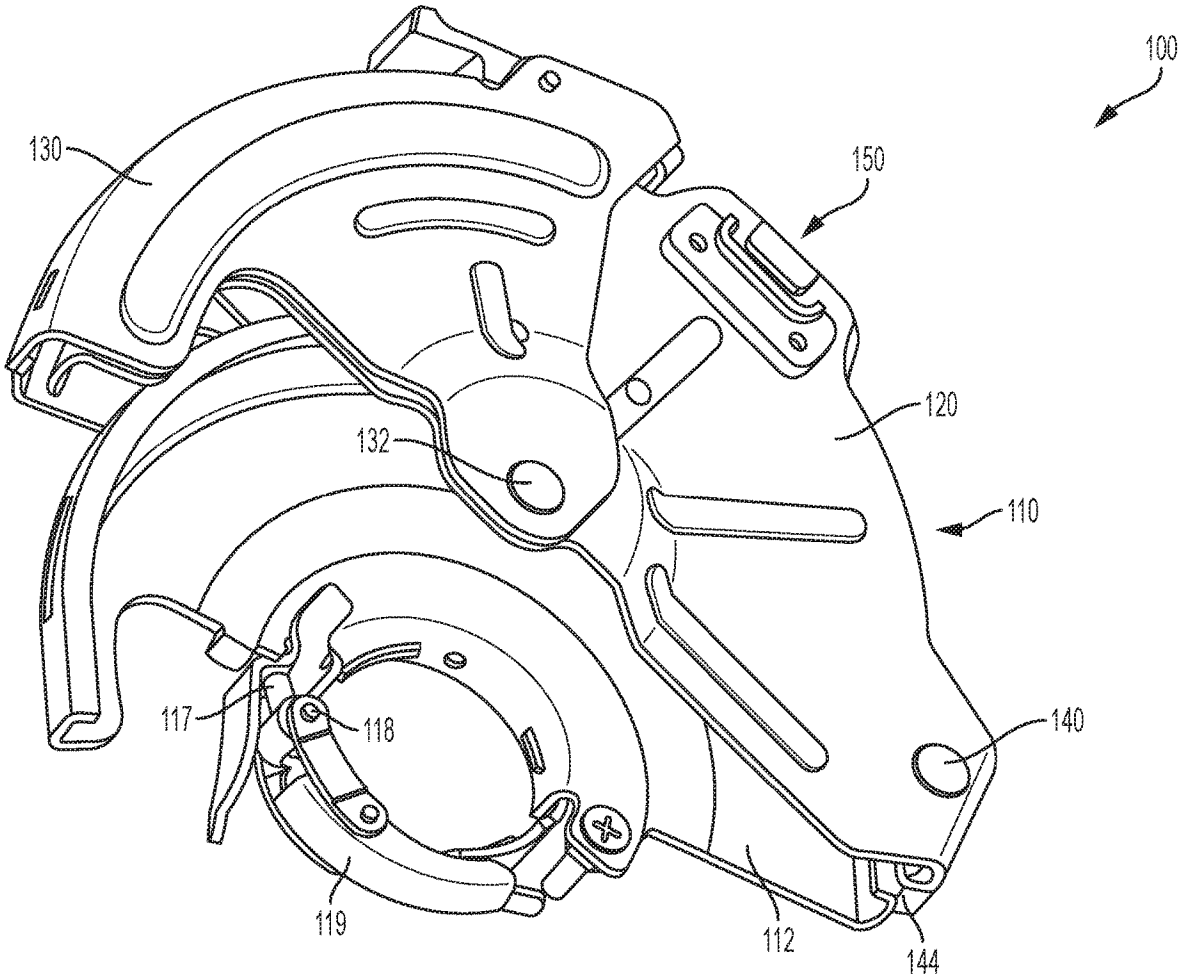
FIG. 7 depicts a perspective view of the guard assembly in an open position, according to an embodiment.
Figure 8:
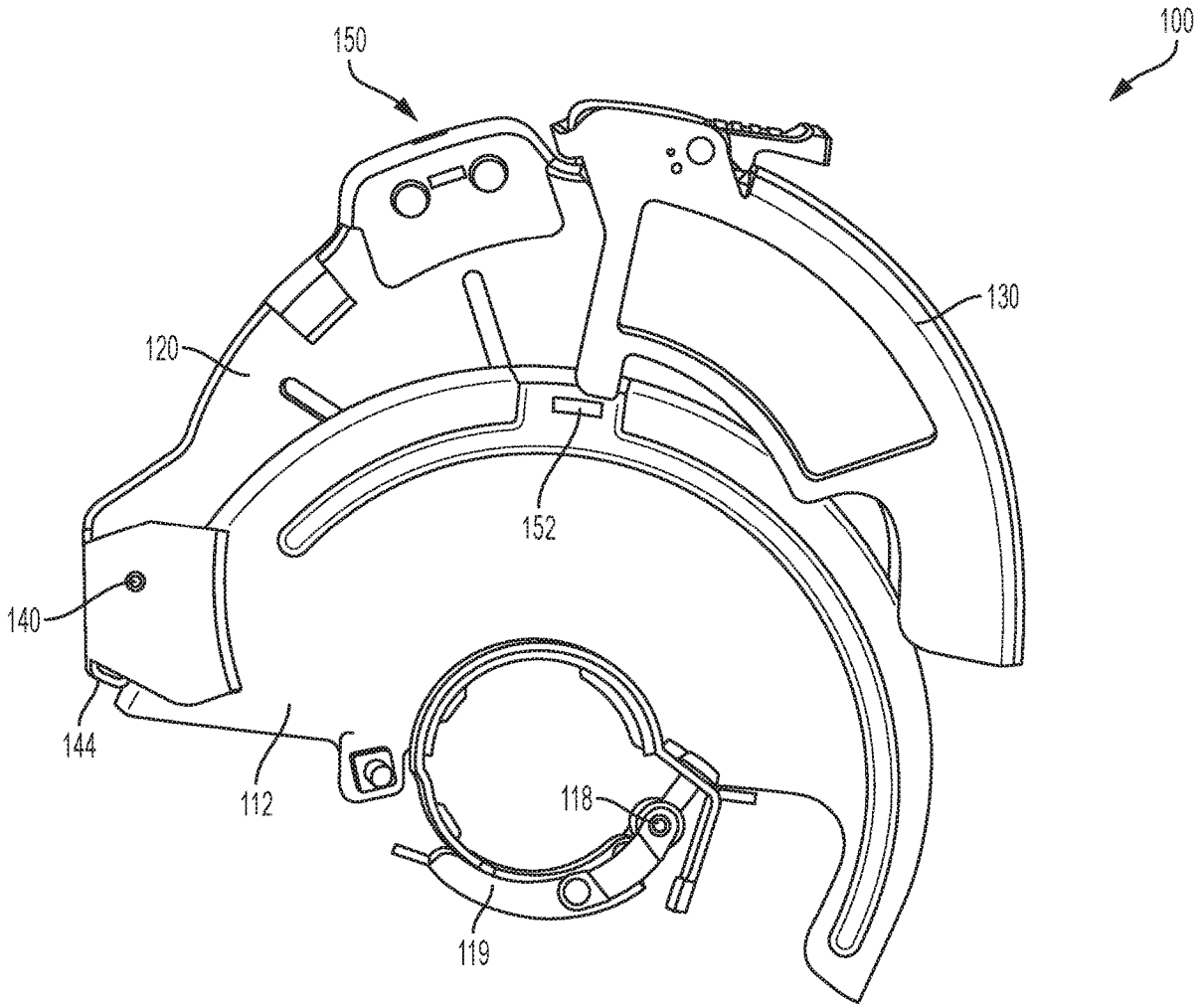
FIG. 8 depicts another perspective view of the guard assembly in open position, according to an embodiment.

FIGS. 7 and 8 depict guard assembly 100 with the inner guard 110 in an "open" position, wherein the inner guard cover 120, together with the outer guard 130, is pivotably moved with respect to the inner guard shell 112, according to an embodiment. This arrangement allows a user to move the inner guard cover 120 (and the outer guard 130) to the "open" position in order to remove or install a grinding wheel onto the grinder spindle. The user then moves the inner guard cover 120 (and the outer guard 130) to the "closed" position prior to operating the tool. In this manner, inner guard cover 110 covers at least half the front and rear surfaces of the wheel accessory, particularly for cutting operations, without the added difficulty in the installation or removal of the wheel accessory with conventional type-1 guards.

With continued reference to FIGS. 5-8, in an embodiment, inner guard 110 includes a guard collar 114 that is configured to lock around the tool collar 36. Guard collar 114 is provided on the inner guard shell 112, in an embodiment. Guard collar 114, together with tool collar 36, provide a locking mechanism for attaching the guard assembly 100 to the angle grinder 10. In an embodiment, guard collar 114 includes one or more tongues 116 that fit within annular track 38 (See FIG. 4) of the tool collar 36. Guard collar 114 also includes a lock handle 119 pivotable around a lock pivot 118. The lock handle 119 is coupled to and pulls on a locking shaft 117, which in turn tightens the guard collar 114 around the tool collar 36 to lock the inner guard shell 112 to the grinder 10.

The guard assembly 100, in this embodiment, is provided with an inner guard rivet 140, which provides a pivoting attachment point between the inner guard cover 120 and the inner guard shell 112. In an embodiment, rivet 140 is provided near an outer periphery of the inner guard shell 112, preferably closer to the tool body 10.

Figure 10:
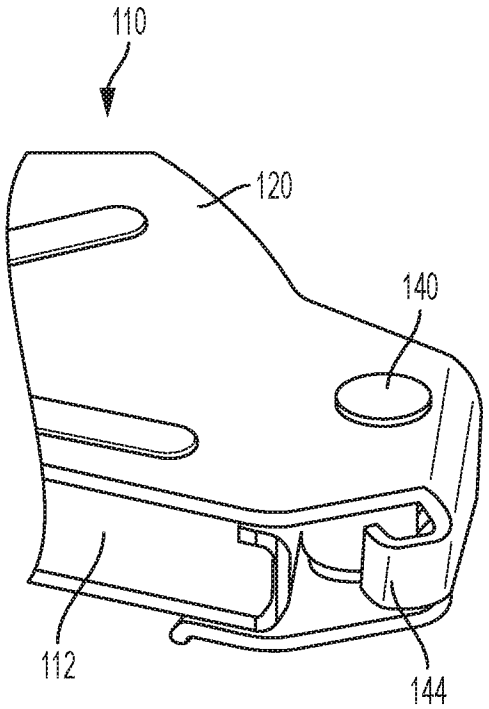
FIG. 10 depicts another zoomed-in perspective view of the pivoting attachment mechanism between the inner guard shell and the inner guard cover of the guard assembly, according to an embodiment.
Figure 9:
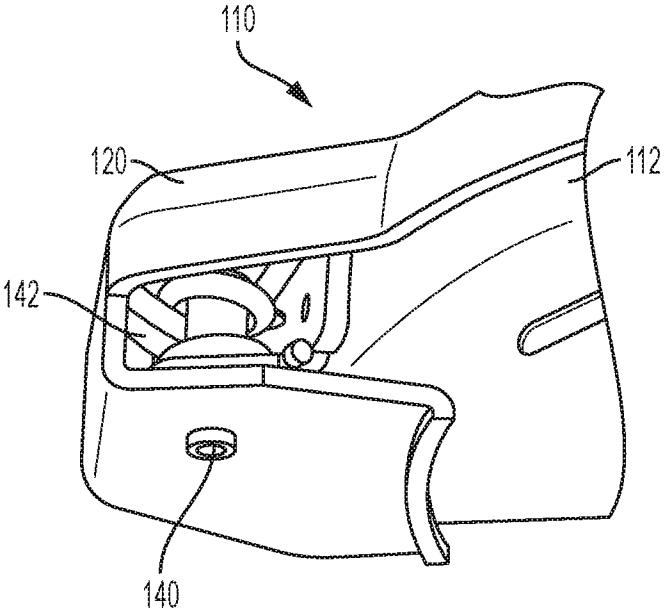
FIG. 9 depicts a zoomed-in perspective view of a pivoting attachment mechanism between the inner guard shell and the inner guard cover of the guard assembly, according to an embodiment.

FIGS. 9 and 10 depict zoomed-in perspective views of the pivoting attachment mechanism between the inner guard shell 112 and the inner guard cover 120, according to an embodiment. As shown in the zoomed-in view of FIG. 9, inner guard 110 may additionally be provided with a spring member 142 provided to bias the guard shell cover 120 into one of the "closed" or "open" positions with respect to the inner guard shell 112. In this example, one leg of the spring member 142 applies a biasing force on an inner wall of the inner guard cover 120 to force it away and out of engagement from the inner guard shell 112 into the "open" position. In an embodiment, spring member 142 may be a double torsion spring around the rivet 140, although other types of spring elements may be utilized.

In yet a further embodiment, as shown in the zoomed-view of FIG. 10, inner guard 110 may be provided with a pivot stop 144 to limit the rotational movement of the inner guard cover 120 around the inner guard rivet 140. In an embodiment, pivot stop 144 is provided at a peripheral end of the inner guard cover 120 near the inner guard rivet 140. The pivot stop 144 may be an extended portion of the inner guard cover 120, bent in the direction of the inner guard shell 112. As the inner guard cover 120 rotates around the inner guard rivet 140 to the "open" position, the end of the pivot stop 144 comes into contact with a peripheral end of the inner guard shell 112, thus limiting its rotational movement. FIGS. 7 and 8 show the pivot stop 144 coming in contact with the inner guard shell 112 when the inner guard 110 in the "open" position.

Figure 11B:
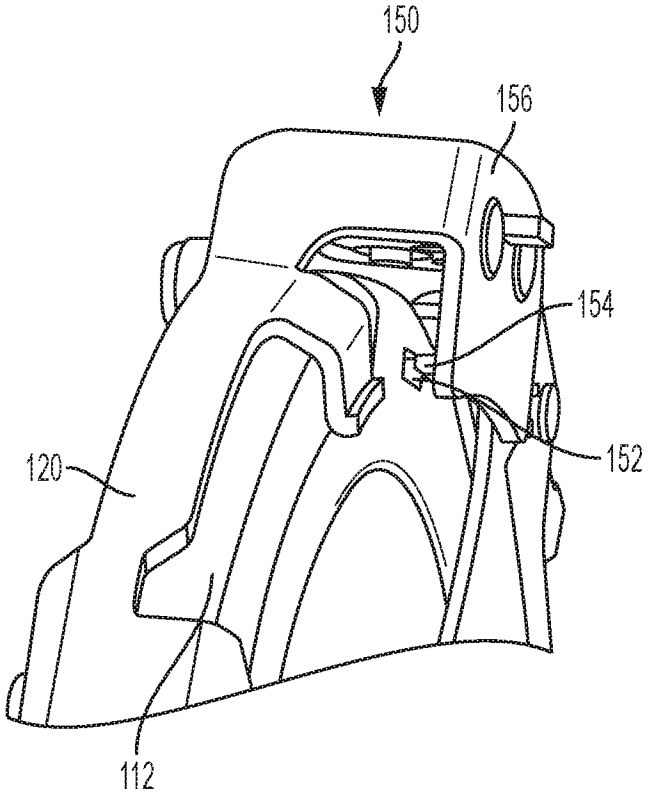
FIGS. 11A and 11B depict zoom-in perspective views of a latching mechanism for the guard assembly, with a latch in the engaged and disengaged positions respectively, according to an embodiment.
Figure 11A:
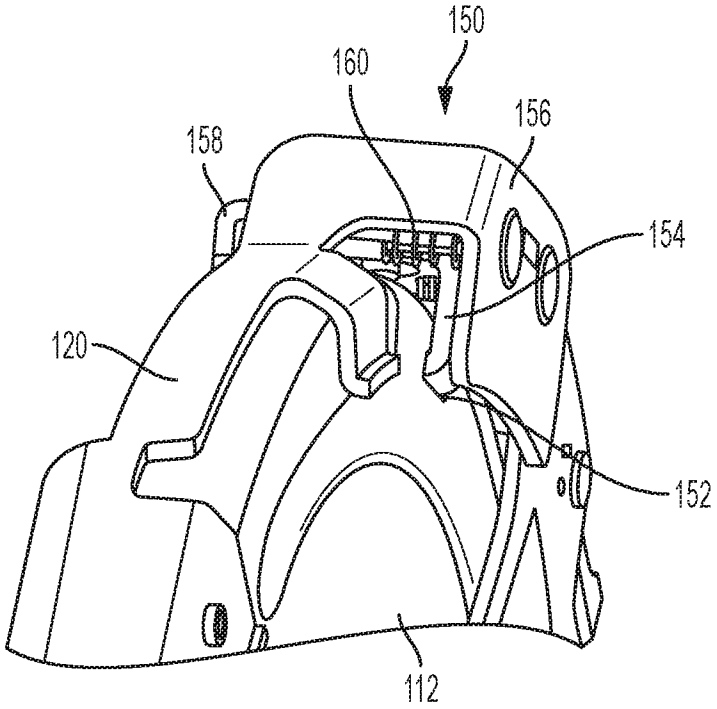
Figure 12:
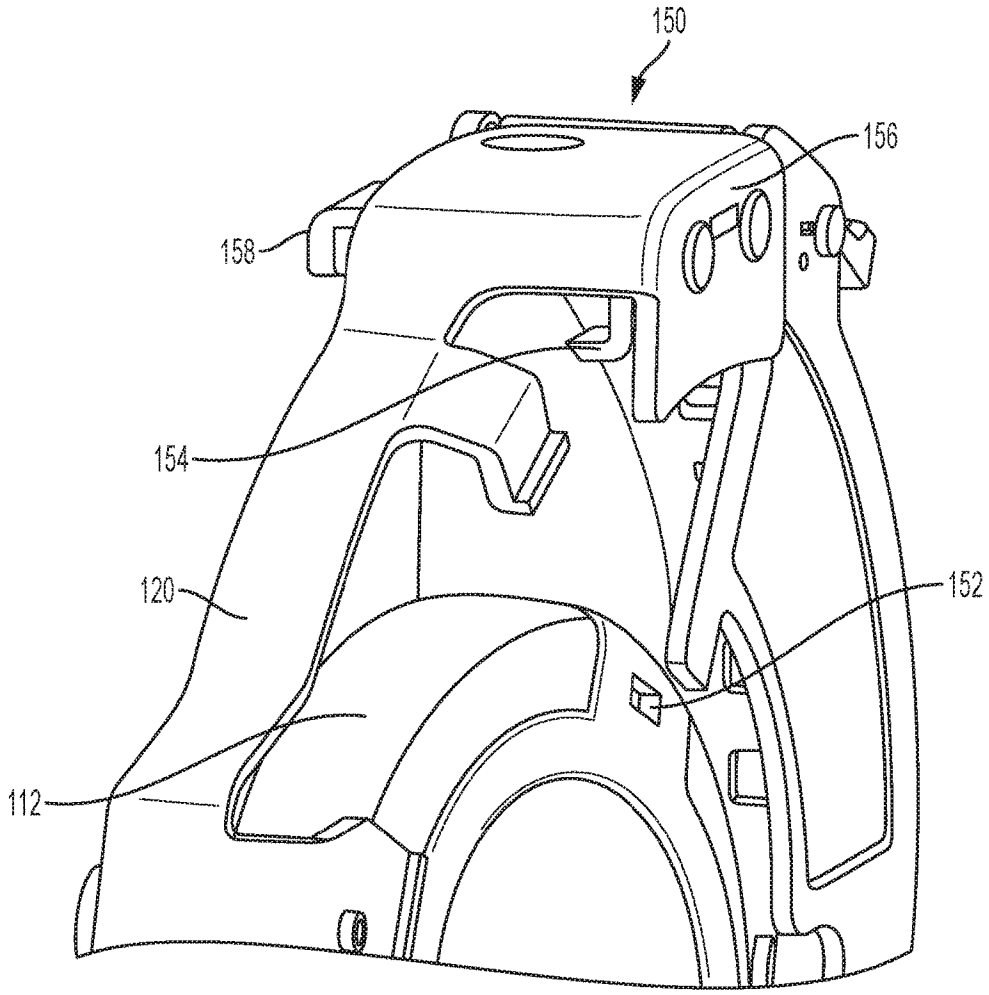
FIG. 12 depicts a zoomed-in perspective view of the latching mechanism with the guard assembly in the open position, according to an embodiment.

FIGS. 11A-13 depict various views of a latch assembly 150 for the guard assembly 100, according to an embodiment. In an embodiment, latch assembly 150 includes a slot 152 provided on an outer surface (and near the periphery) of the inner guard shell 112, and a latch 154 provided on the inner guard cover 120 that selectively engages the slot 152. FIGS. 11A and 11B depict the latch 154 in the engaged and disengaged positions respectively, according to an embodiment. The latch 154 is provided in a latch housing 156 on the outer periphery of the inner guard cover 120. The latch 154 is coupled to an actuator member 158 provided on a side of the latch housing 156. The latch 154 is also coupled to a spring element 160, which engages the opposite side of the latch housing 156. Normally, the latch 154 is spring-loaded to engage the slot 152 of the inner guard shell 112, as shown in FIG. 11A. Pressing the actuator member 158 causes the latch 152 to disengage the slot 152 of the inner guard shell 112 against the force of the spring 160, as shown in FIG. 11B. This allows the inner guard cover 120 to disengage the inner guard shell 112 and be pivotably moved to the "open" position, as shown in FIG. 12. In an embodiment, when the inner guard cover is moved to the "closed" position by the user, the latch 154 slides over an outer surface of the inner guard shell 112, against the force of the spring 160, until it re-engages the slot 152.

Figure 13:
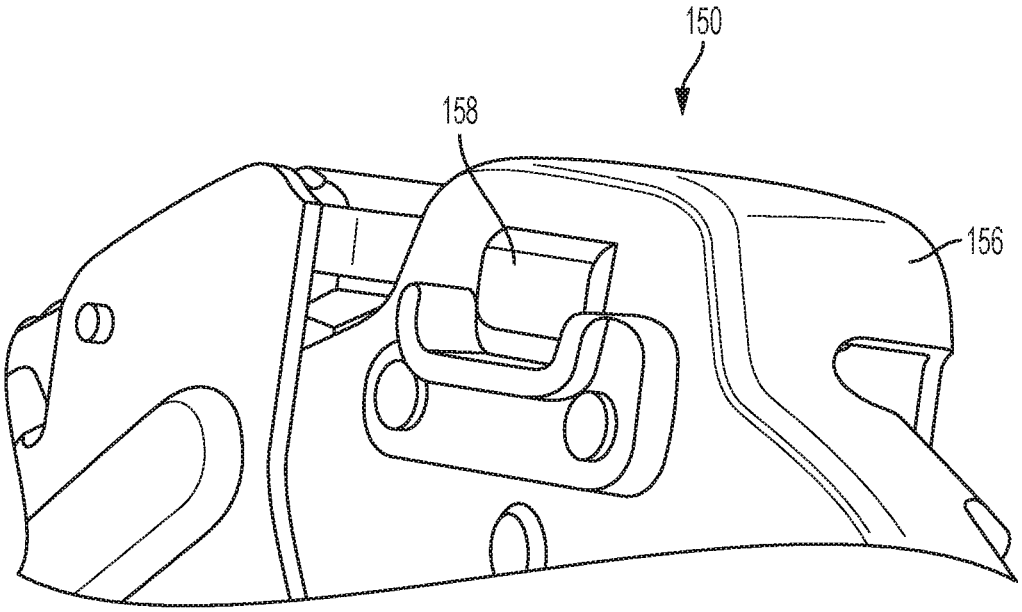
FIG. 13 illustrates another perspective view of the latch assembly, according to an embodiment.
Figure 14:
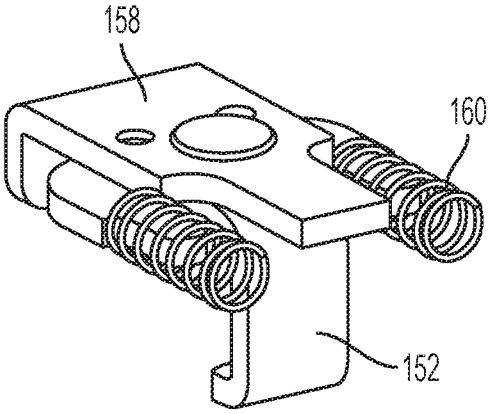
FIG. 14 depicts a perspective view of a latch, an actuator member, and a spring element of the latch assembly, according to an embodiment.

FIG. 13 illustrates a perspective view of the latch assembly 150 showing the actuator member 158 pressed in, according to an embodiment. FIG. 14 depicts a perspective view of the latch 152, actuator member 158, and spring element 160, according to an embodiment.

The embodiment of the invention described above provides a guard assembly that covers at least approximately half of each surface of the abrasive wheel. This arrangement provides more safety for the user, particularly in a cutting operation, and makes it easier for the user to install or remove the abrasive wheel.

Moreover, according to the described embodiment, the guard may be moved to an "open" position by the user prior to installing or removing the abrasive wheel. Thus, the overall thickness of the guard assembly may be substantially reduced in comparison to conventional stationary type-1 guards that must be sufficiently thick to allow insertion and installation of the abrasive wheel within the inner space of the guard.

Figure 15:
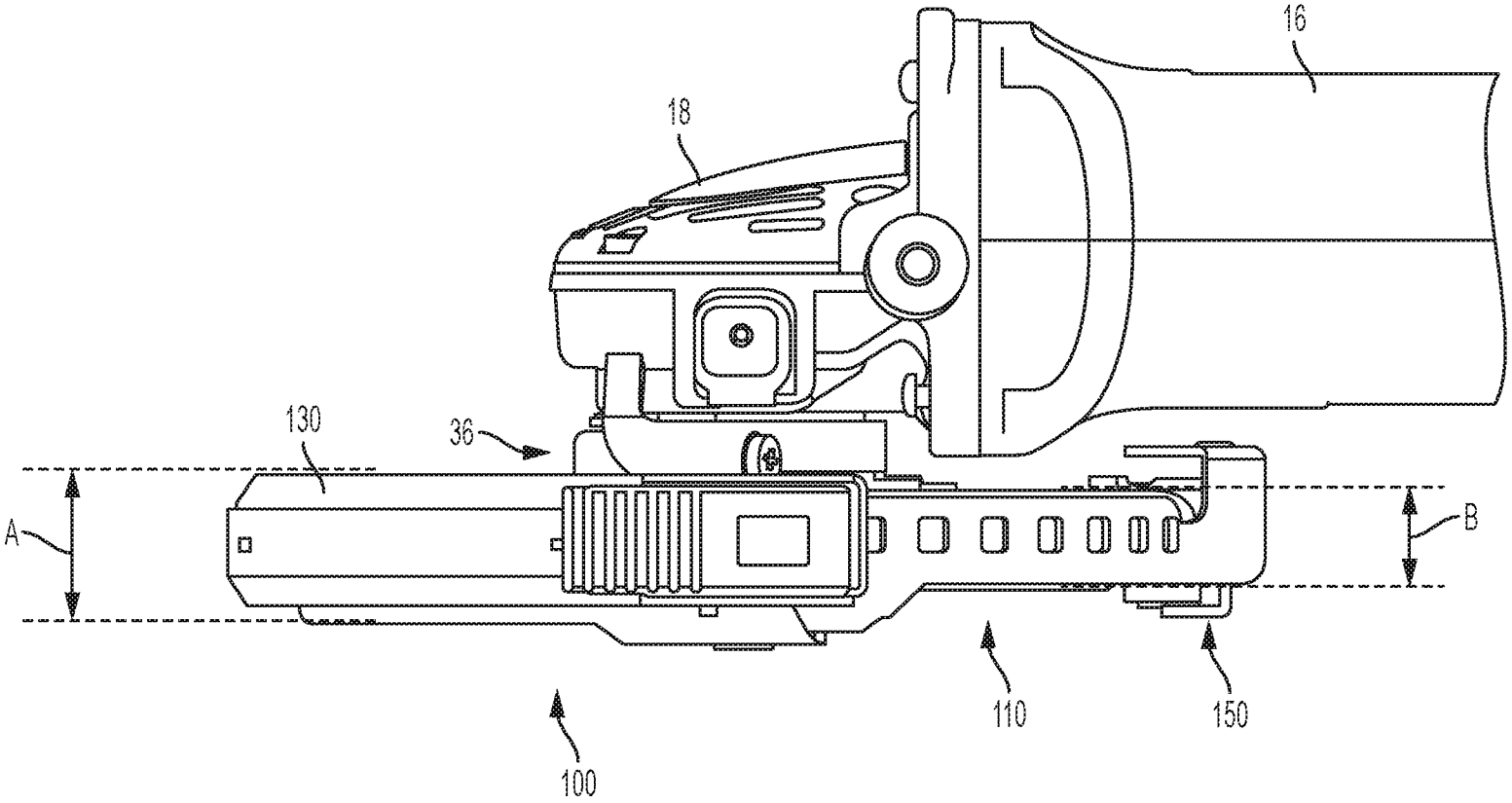
FIG. 15 depicts a top view of the guard assembly, according to an embodiment.

In an embodiment, as shown in FIG. 15, the thickness (A) of the guard assembly 100, as measured by the distance from the inner and outer surfaces of the outer guard 130 (i.e., surfaces having the largest surface area, not including the area near the center that houses the spindle) is less than or equal to approximately 33 mm, more preferably less than or equal to approximately 30 mm, even more preferably less than or equal to approximately 27 mm. The thickness of the outer guard 130 is substantially smaller than conventional guards that have a thickness of 4-5 cm. Furthermore, the thickness (B) of the guard assembly 100 as measured by the distance from the inner and outer surfaces of the inner guard 110 (i.e., surfaces of the inner guard shell 112 and inner guard cover 120 having the largest surface area, not including the area near the center that houses the spindle) is less than or equal to approximately 25 mm, more preferably less than or equal to approximately 22 mm, even more preferably less than or equal to approximately 18 mm. Thus, from the user's perspective, guard assembly 100 provides the user more visibility on the workpiece than the conventional type-1 guards.

While this aspect of the invention described above is made with reference to a guard assembly 100 including an outer guard 130, it must be understood that the guard assembly 100 without an outer guard 130 is within the scope of the above-described aspect of the invention. In other words, a two piece guard including a guard shell 112, a guard cover 120, and a rivet 140 that allows the user move the guard cover 120 between "open" and "closed" positions as needed is within the scope of the above-described aspect of the invention. It is also noted that while this embodiment discloses a latch assembly 150 including a spring-loaded latch 152, any known fastening means for attaching/detaching the inner guard cover 120 may be alternatively utilized.

A second aspect of the invention relating to the outer guard 130 is described herein with reference to FIGS. 16-25.

In an embodiment, guard assembly 100 is provided with outer guard 130, which is adjustably rotatably moveable between a retracted position and an extended position to allow the user to cover from approximately 180 degree to 270 degrees of the outer periphery of the abrasive wheel. This arrangement provides the user with the flexibility to expose a smaller portion of the abrasive wheel, particularly in cutting applications, as desired by the user.

Figure 16:
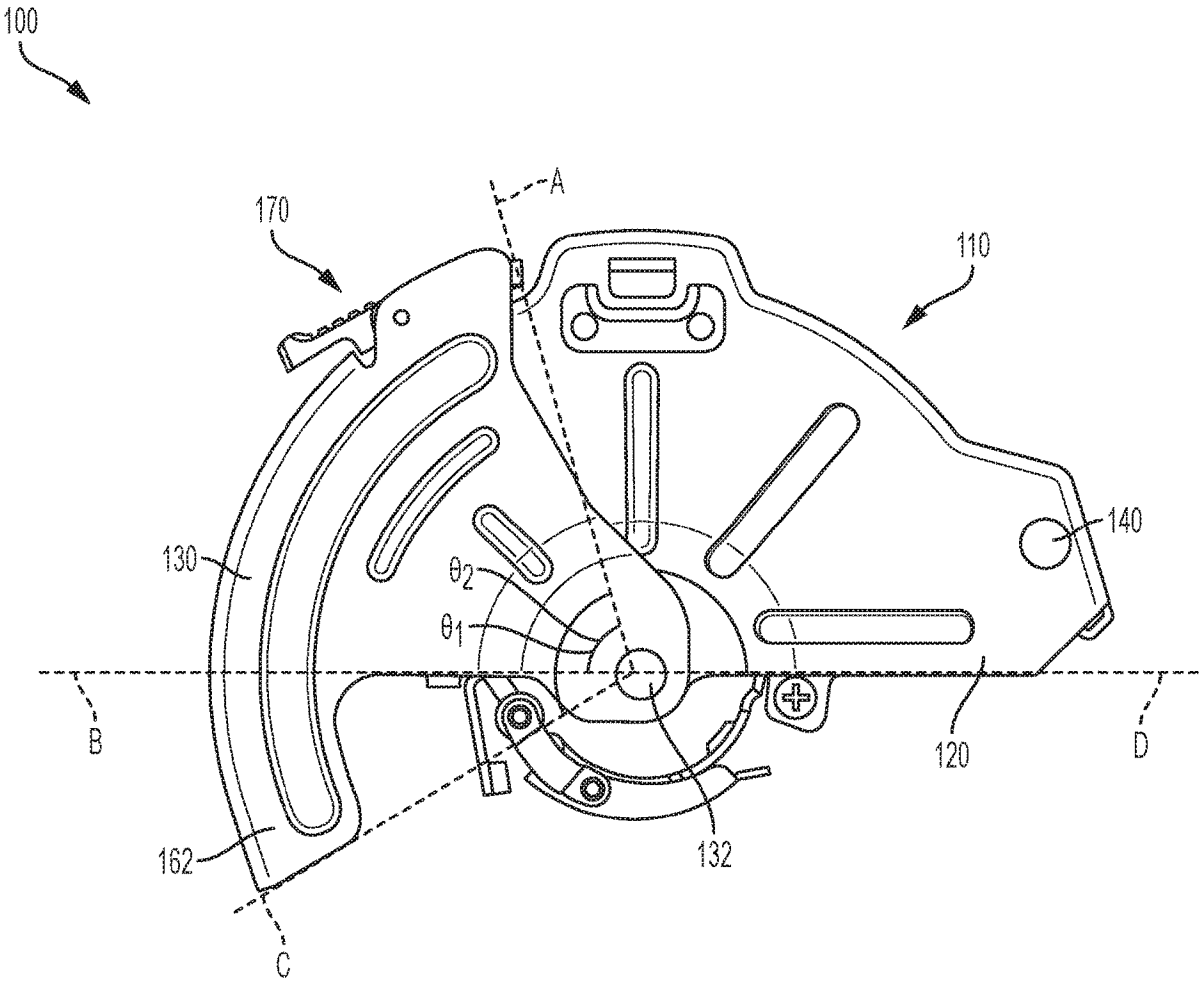
FIG. 16 depicts a side view of the guard assembly with outer guard in a retracted position.
Figure 17:
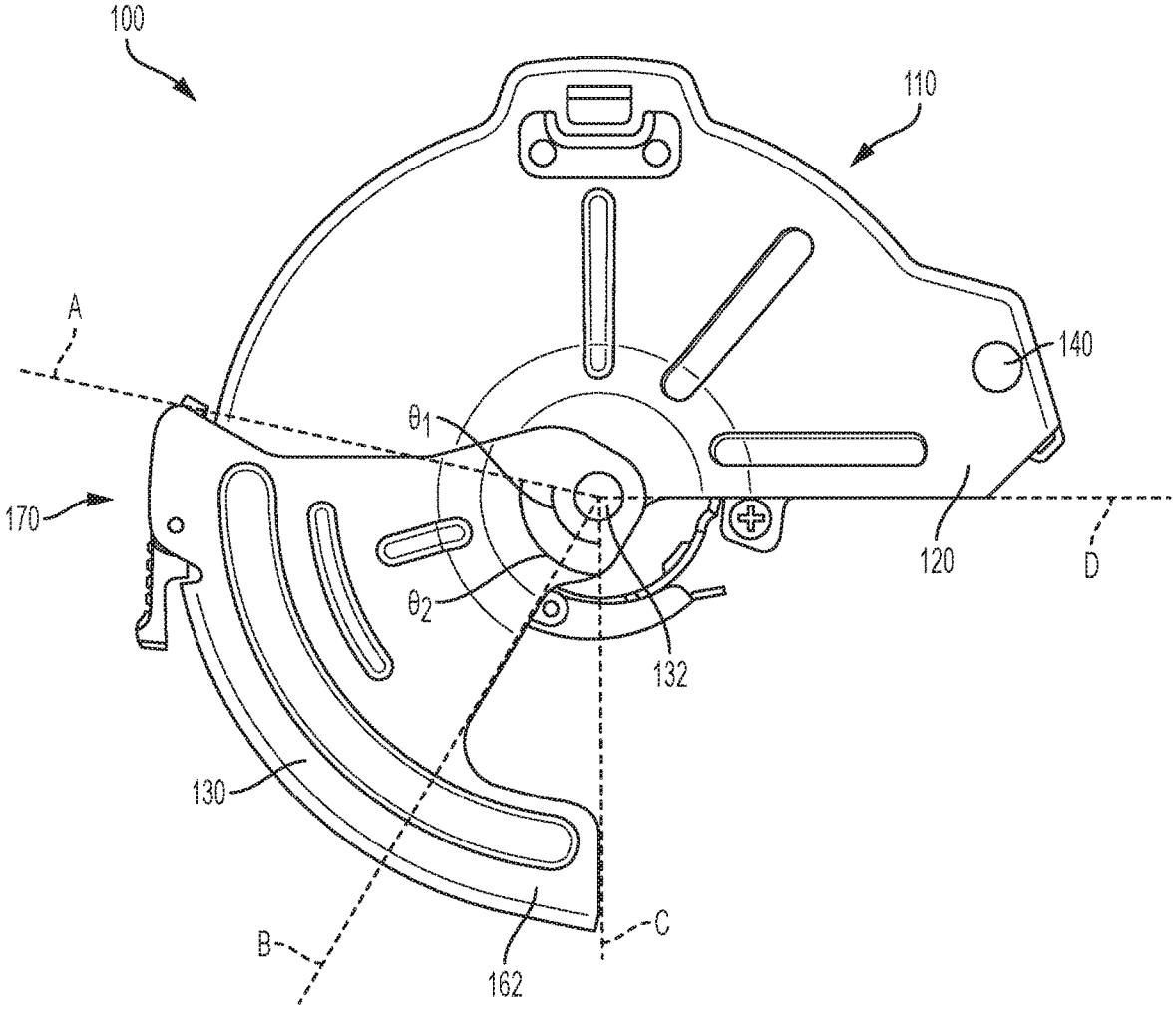
FIG. 17 depicts a side view of the guard assembly with the outer guard in a fully extended position.
Figure 18:
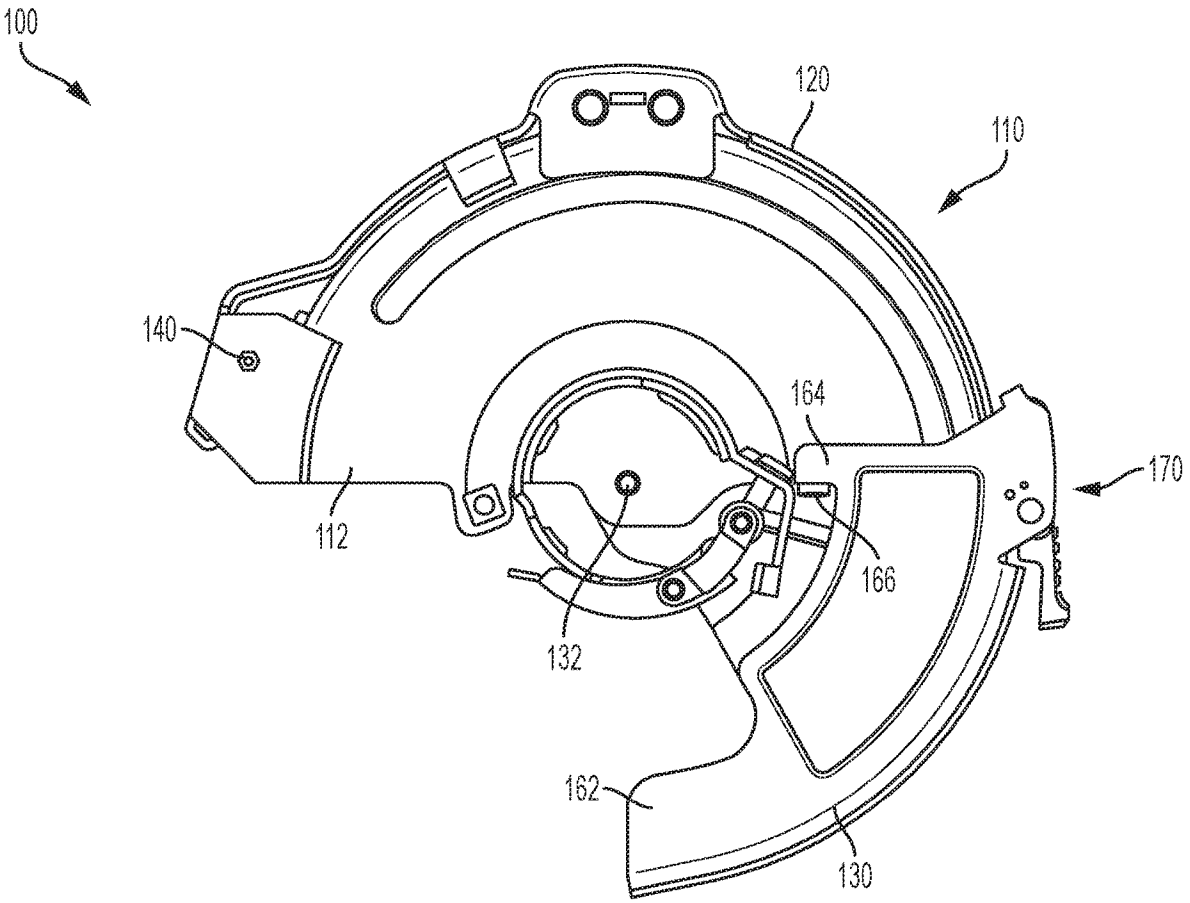
FIG. 18 depicts a rear side view of the guard assembly with the outer guard in a fully extended position.

FIG. 16 depicts a side view of the guard assembly 100 with the outer guard in a default retracted position. FIG. 17 depicts a side view of the guard assembly 100 with the outer guard 130 in a fully extended position. FIG. 18 depicts a rear side view of the guard assembly 100 with the outer guard 130 in a fully extended position. As shown in these figures, in an embodiment, the outer guard 130 is rotatably attached to the inner guard cover 120 via an outer guard rivet 132 provided on a radial center of the inner guard cover 120. The outer guard 130 if further secured to the inner guard cover 120 via lock assembly 170, as explained in detail below. The outer guard 130 is rotatably moveable with respect to the inner guard 110 around the outer guard rivet 132 between its retracted position and fully extended position. The outer guard 130, in an embodiment, may cover an area of up to approximately 90 degrees of the outer periphery of the inner guard 110 when it is in the fully retracted position, leaving an angular area of up to approximately 120-180 degrees of the abrasive wheel exposed. In the fully extended position, the outer guard 130 may cover a small angular area of the outer periphery of the inner guard 110, leaving an area of up to approximately 60-120 degrees of the abrasive wheel exposed.

In the illustrated example of FIG. 16, the outer guard 130 covers an angular area of approximately 75 degrees (i.e., angle 81 defined between lines A and B) of the outer periphery of the inner guard 110 when it is in the fully retracted position. In an embodiment, the outer guard 130 includes an extended portion 162 at its peripheral end that angularly extends beyond a peripheral end of the inner guard 110 when the outer guard 130 is in the fully retracted position. In an embodiment, the extended portion may cover an angular area of approximately 30 degrees beyond a peripheral end of the inner guard 110 (defined between lines B and C), leaving approximately 150 degrees of the grinding wheel exposed in the fully retracted position of the outer guard 130. In an embodiment, the total peripheral length of the outer guard 130, included the extended portion 162, covers an angular area of over 100 degrees (i.e., angle 82 defined between lines A and C).

In the fully extended position as shown in FIG. 17, in an embodiment, the outer guard 130, together with inner guard 110, cover a peripheral area of approximately 240 degrees (defined by lines B and D) of the wheel, leaving approximately 120 degrees of the wheel exposed. Including the extended portion 162, in an embodiment, the outer guard 130, together with inner guard 110, cover a peripheral area of approximately 270 degrees (defined by lines C and D) of the wheel, leaving approximately 90 degrees of the wheel exposed. It is noted that there is some angular overlap between the inner guard 110 and the outer guard 130 in the fully extended position to support the lock assembly 170, as discussed below.

In an embodiment, the outer guard 130 is further provided with a first stop member 164 radially projecting from an inner surface of the outer guard 130, as shown in FIG. 18. In an embodiment, a corresponding second stop member 166 is provided projecting outwardly from an end of the inner guard 110 (e.g., from the inner guard shell 112). When the outer guard 130 is pulled by the user to its fully extended position, the first stop member 164 comes into contact with the second stop member 166, preventing further movement of the outer guard 130. This prevents the outer guard 130 from traveling too far out of contact with the inner guard 110.

Lock assembly 170 for the outer guard 130 of the guard assembly 100 is described herein with reference to FIGS. 19-22, according to an embodiment.

Figure 19:
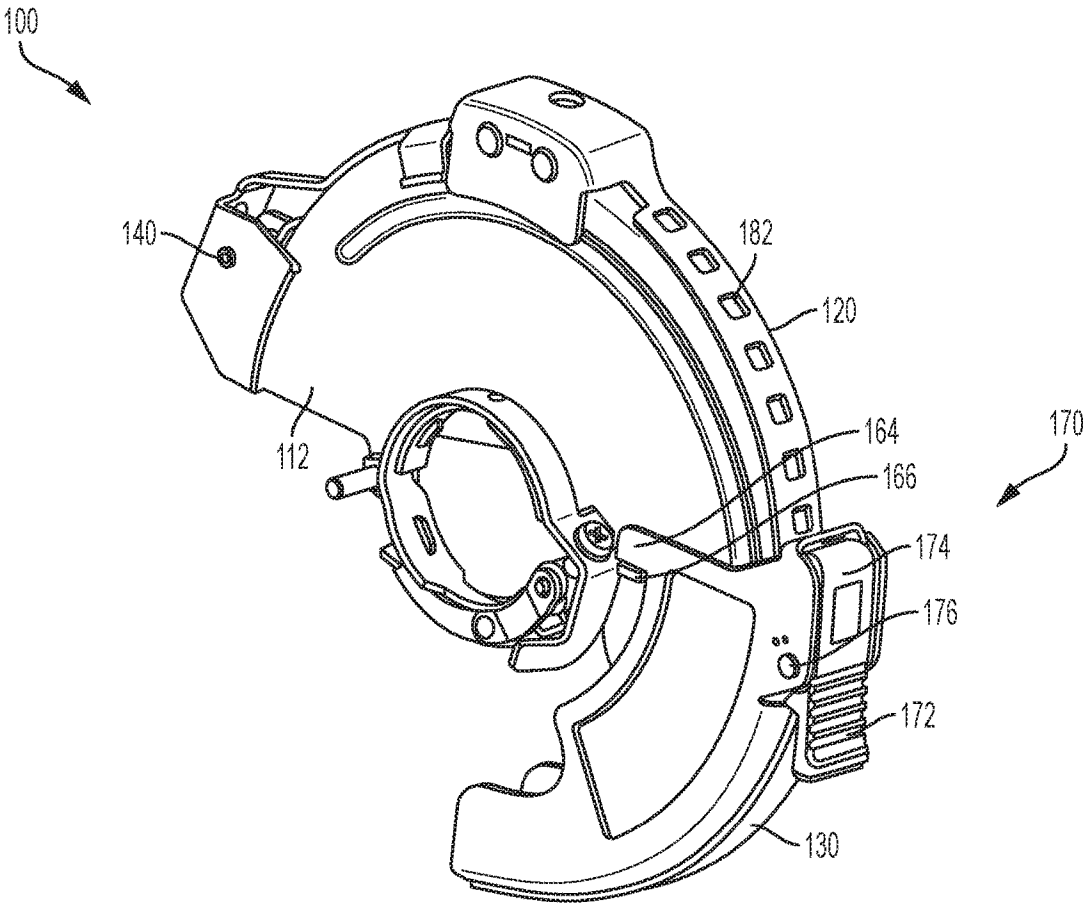
FIG. 19 depicts a perspective view of the guard assembly with the outer guard in a fully extended position.

FIG. 19 depicts a perspective view of the guard assembly 100 including the lock assembly 170, according to an embodiment. In an embodiment, lock assembly 170 includes an actuation member 172 and an engagement portion 174 extending oppositely along a substantially plane from a pivot member 176. Pivot member 176 is secured to both surfaces of the outer guard 130 near the outer periphery of outer guard 130.

Figure 21:
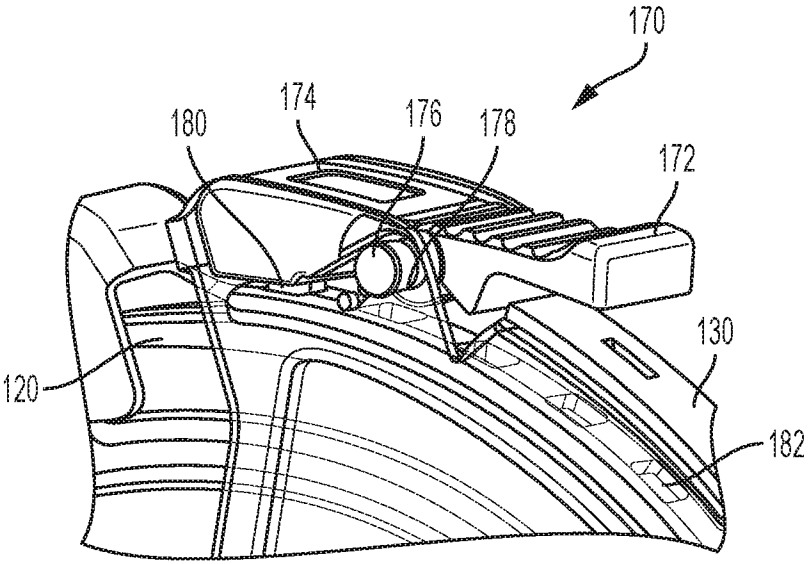
FIG. 21 depicts a perspective view of the locking mechanism, with portions of the outer guard illustrated transparently to show the components of the locking mechanism, according to an embodiment.
Figure 20:
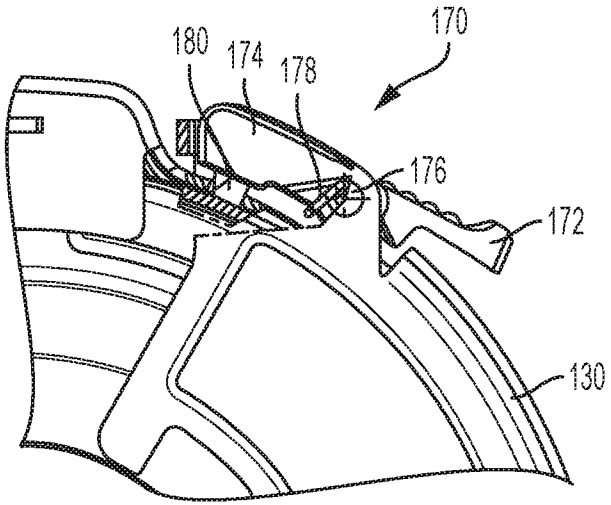
FIG. 20 depicts a side view of the locking mechanism, with portions of the outer guard and inner guard illustrated transparently to show the components of the locking mechanism, according to an embodiment.
Figure 22:
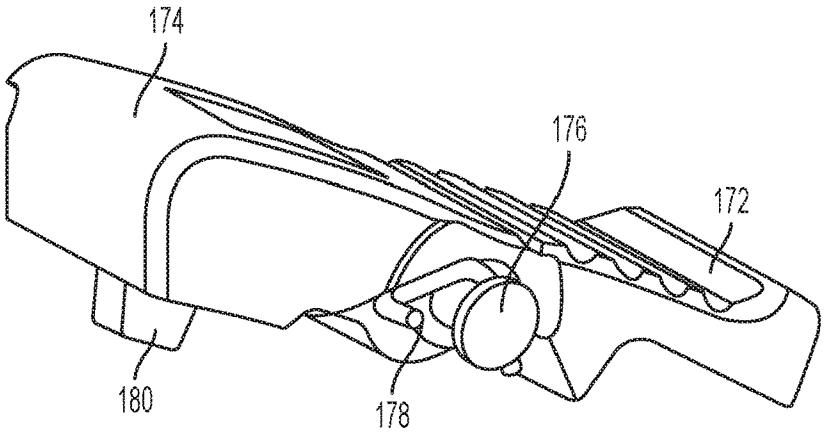
FIG. 22 depicts a perspective view of the locking mechanism actuation member and engagement portion, according to an embodiment.

FIGS. 20 and 21 depict side and perspective views of the lock assembly 170, with portions of the outer guard 110 and inner guard 120 shown transparently to illustrate the components of the locking mechanism, according to an embodiment. FIG. 22 depicts a perspective view of the lock assembly 170 actuation member 172 and engagement portion 174, according to an embodiment. In an embodiment, engagement portion 174 of the lock assembly 170 includes an engagement projection 180 that extends downwardly towards the inner guard 110. In an embodiment, the outer periphery of the inner guard 110 includes a series of slots 182. In an embodiment, the slots 182 are provided on the outer periphery of inner guard cover 120, thought slots 182 may alternatively or additionally be provided on the outer periphery of inner guard shell 112. Actuation of actuation member 172 by the user causes the engagement projection 180 to disengage from a corresponding slot 182. The user may then drag and rotationally reposition the outer guard 130 as desired prior to the engagement projection 180 reengaging another one of the slots 182. In an embodiment, the lock assembly 170 includes a spring member 178 that biases the engagement portion 174 towards the inner guard 110. In an embodiment, the spring member 178 is a torsion spring disposed around the pivot member 176, with one leg engaging the outer guard 130 and another leg engaging the actuation portion 174, as shown in FIG. 21. The spring member 178 biases the engagement projection 180 towards the inner guard 110, and into one of the slots 182 of the inner guard 110, when the user is not pressing the actuation portion 174.

Figure 23:
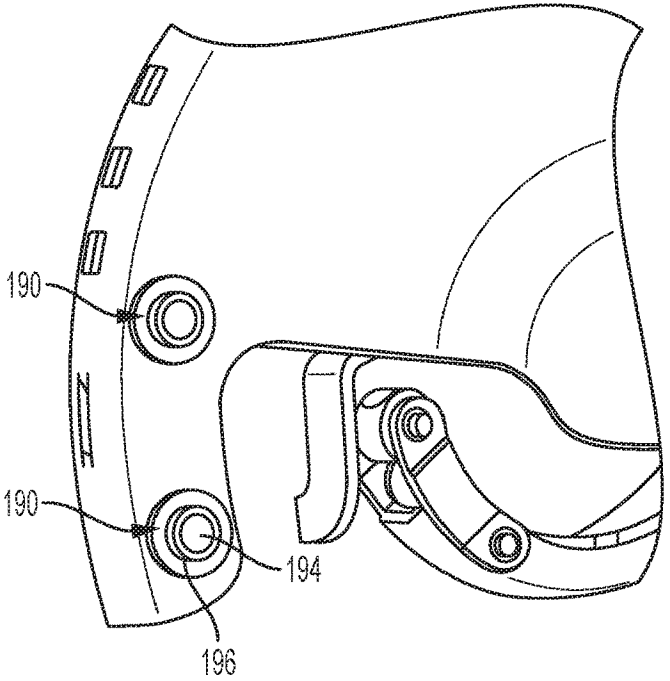
FIG. 23 depicts a zoomed-in perspective view of the inner guard including the guides, according to an embodiment.
Figure 25:
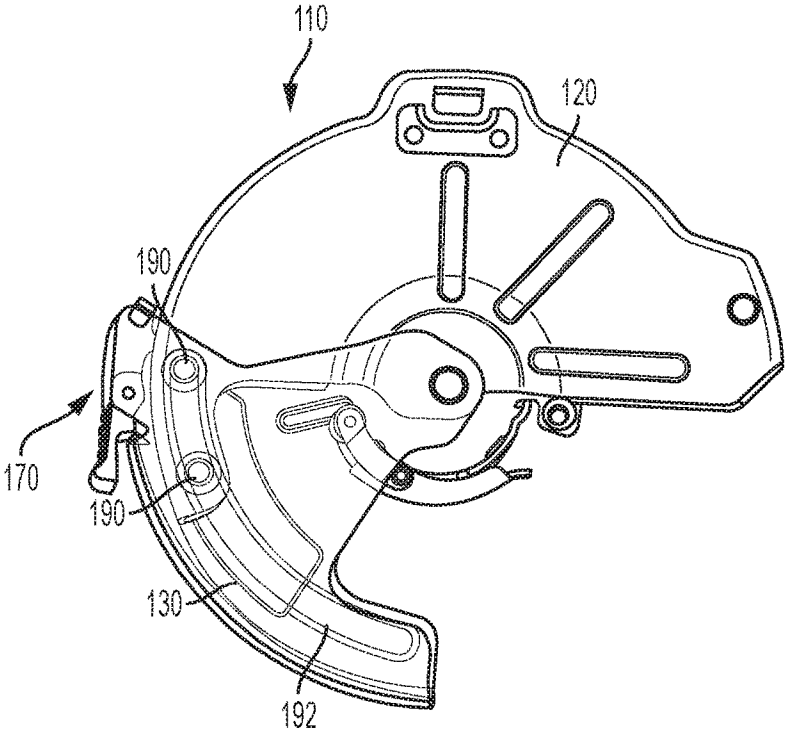
FIG. 25 depicts a side view of the guard assembly with outer guard outer guard illustrated transparently in its extended position to show the guides and channels, according to an embodiment.
Figure 24:
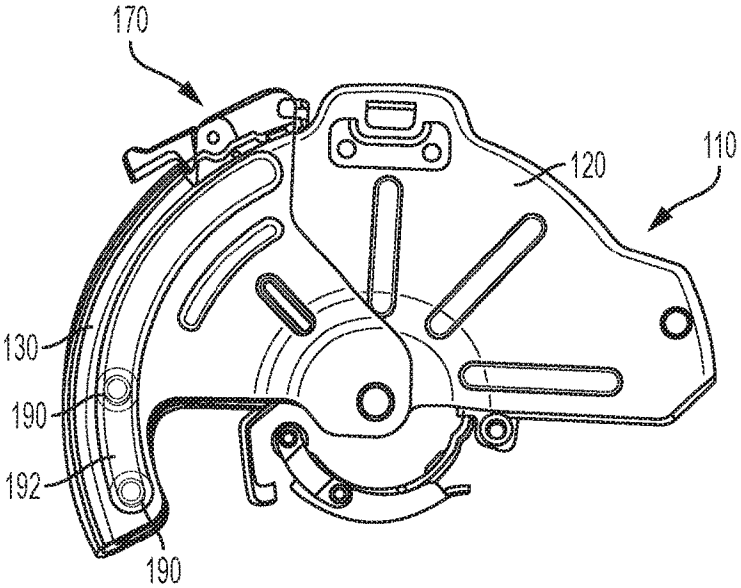
FIG. 24 depicts a side view of the guard assembly with outer guard outer guard illustrated transparently in its retracted position to show the guides and channels, according to an embodiment.

Referring now to FIGS. 23-25, in an embodiment of the invention, inner guard 110 may be provided with one or more guides 190 on one of its surfaces (e.g., on the inner guard 120) near its outer periphery, and the outer guard 130 may be provided with a corresponding channel 192 that receives the guide 190 therein. FIG. 23 depicts a zoomed-in perspective view of the inner guard 110 including the guides 190. FIGS. 24 and 25 depict a side view of the guard assembly with outer guard outer guard 130 illustrated transparently in its retracted position and extended position, respectively, in an embodiment. As the outer guard 130 is rotated around the outer guard rivet 132, guide(s) 190 slides through the channel 192. Guide(s) 190 in this matter provide structural support to the outer guard 130, facilitate a smooth rotation of the outer guard 130 with respect to the inner guard 110, and limit the rotational movement of the outer guard 130. In an embodiment, each guide 190 may include a pin 194 and a guide portion 196, as shown in FIG. 23. In an embodiment, guide portion 196 may be a metal part shaped to fit in the channel 192, and pin 194 is a rivet that attaches the guide portion 196 to the inner guard 110. In an alternative embodiment, alternatively, guide 190 may be projection or stamping formed integrally with the inner guard 110.

Figure 26:
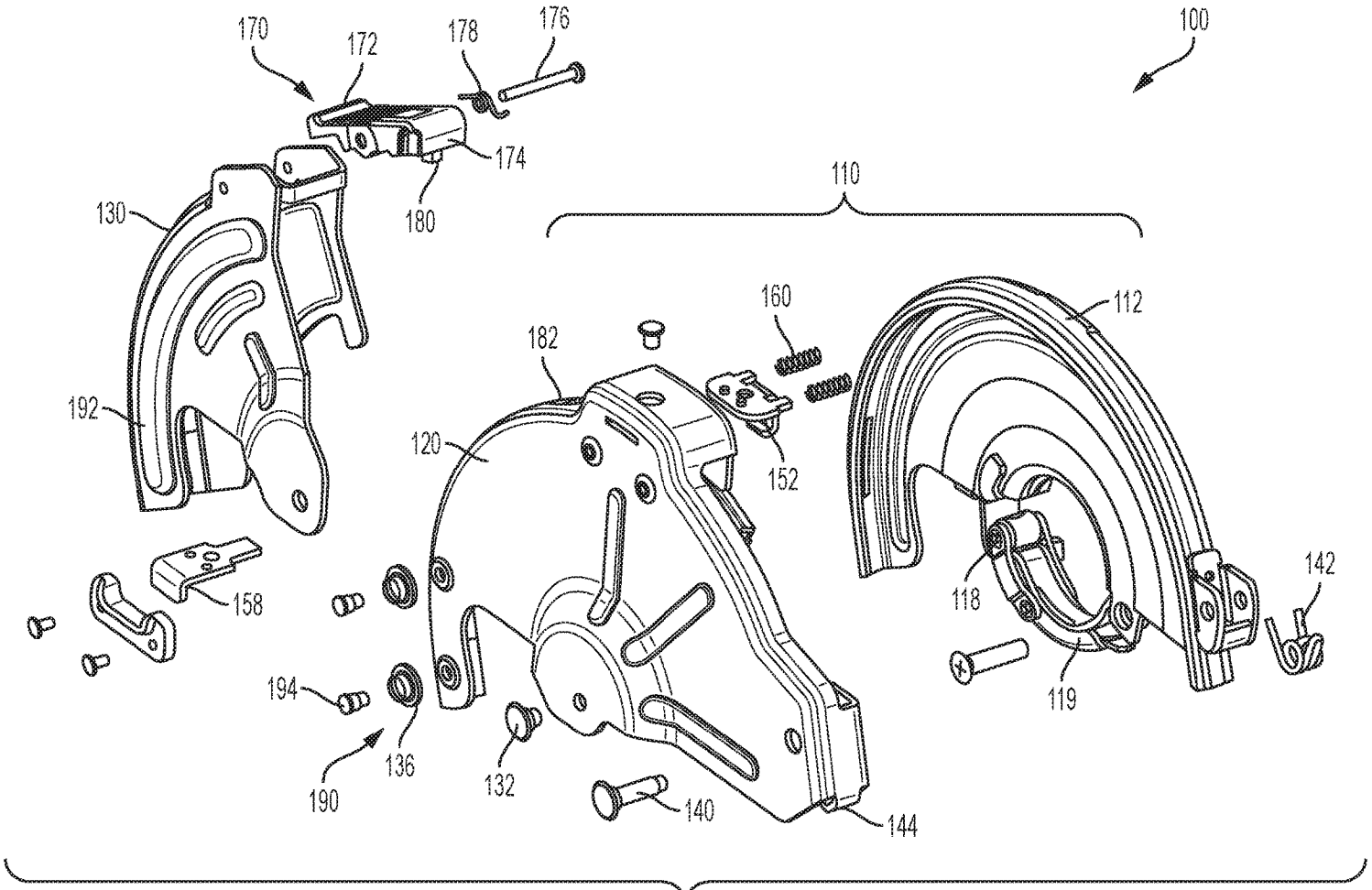
FIG. 26 depicts an exploded view of the guard assembly, according to an embodiment of the invention.

FIG. 26 depicts an exploded view of the guard assembly 100, according to an embodiment of the invention. This figure is provided for illustration purposes depicting the various components of the guard assembly 100 described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE NUMERALS

100 guard assembly
12 housing
14 handle portion
16 field case
18 gear case
20 first end
22 second end
26 outlets
28 trigger switch
34 wheel spindle
36 tool collar
38 annular track
110 inner guard
112 inner guard shell
114 guard collar
116 tongue
118 lock pivot
117 locking element
119 lock handle
120 inner guard cover
130 outer guard

132 outer guard rivet
140 inner guard rivet
142 spring member
144 pivot stop
150 latch assembly
152 slot
154 latch
156 latch housing
158 actuator member
160 latch spring
162 extended portion (outer guard)
164 first stop member
166 second stop member
170 lock mechanism
172 actuation member
174 engagement portion
176 pivot member
178 spring element
180 engagement projection
182 slot
190 guide
192 channel
194 pin
196 guide portion

The invention claimed is:

1. A guard assembly for an abrasive accessory of a power tool, comprising:

a guard shell being associated with a first surface of the abrasive accessory and secured to the power tool around an output spindle of the power tool;

a guard cover being associated with a second surface of the abrasive accessory opposite the first surface and attached to the guard shell at a pivot point having an axis that is at a distance from an axis of the spindle, the guard cover being rotatably movable with respect to the guard shell around the pivot point between a closed position and an open position; and a latch assembly arranged to secure the guard cover to the guard shell in the closed position, the latch assembly comprising a latch housing disposed on the guard cover, a latch engaging the latch housing, a slot in the guard shell selectively engageable by the latch, a spring disposed between the latch and the latch housing to bias the latch inside the slot in the closed position, and an actuator member arranged to disengage the latch from the slot against the force of the spring, wherein in the closed position, the guard shell and the guard cover are configured to cover approximately half or more of the first and second surfaces of the abrasive accessory respectively, and in the open position, the guard shell covers approximately half or more of the first surface of the abrasive accessory but the guard cover covers less than half of the second surface of the abrasive accessory.

2. The guard assembly of claim 1, wherein the guard shell comprises a guard collar configured to lock around a tool collar of the power tool located around the output spindle of the power tool.

3. The guard assembly of claim 1, wherein the pivot point comprises a rivet rotatably attaching the guard cover to the guard shell, the rivet being located near an outer periphery of the guard shell.

4. The guard assembly of claim 1, wherein the guard shell includes an outer circumferential portion that covers approximately half or more of a peripheral edge of the abrasive accessory, and the guard cover covers the outer circumferential portion of the guard shell in the closed position but is radially separated from the outer circumferential portion of the guard shell in the open position.

5. The guard assembly of claim 1, further comprising a spring member arranged to bias the guard cover into the open position with respect to the guard shell.

6. The guard assembly of claim 1, further comprising a pivot stop arranged near the pivot point to limit a rotational movement of the guard cover with respect to the guard shell around the pivot point in the open position.

7. The guard assembly of claim 1, wherein the guard shell includes a semi-disc-shaped surface facing a portion of the first surface of the abrasive accessory and the peripheral portion covering a peripheral portion of the abrasive accessory.

8. The guard assembly of claim 7, wherein the guard cover includes a semi-disc-shaped surface facing a portion of the second surface of the abrasive accessory in the closed position.

9. The guard assembly of claim 1, wherein a thickness of the guard assembly as defined between outer surfaces of the guard shell and guard cover is less than or equal to approximately 25 mm.

10. The guard assembly of claim 1, further comprising an outer guard secured to the guard cover at a second pivot point along or in close proximity to an axis of the spindle, the outer guard being rotatably movable with respect to the guard cover around the second pivot point between: i) a retracted position, wherein the outer guard, the guard cover, and the guard shell together cover a first angular area of the abrasive accessory, and ii) an extended position, wherein the outer guard, the guard cover, and the guard shell together cover a second angular area of the abrasive accessory larger than the first angular area.

11. The guard assembly of claim 10, further comprising a lock assembly disposed on an outer periphery of the outer guard and configured to secure an angular position of the outer guard with respect to the guard cover.

12. The guard assembly of claim 11, wherein the guard cover comprises a plurality of spaced-apart peripheral slots engageable by the lock assembly to angularly secure the outer guard to the guard cover.

13. The guard assembly of claim 10, wherein one of the outer guard or the guard cover comprises an arcuate channel arranged to slidably receive at least one guide member therein, wherein the at least one guide member travels through the channel as the outer guard is rotated with respect to the guard cover, and wherein the ends of the arcuate channel provide stops for the guide member in the retracted and extended positions.

14. A power tool comprising:

an output spindle driven by an electric motor; and a guard assembly for an abrasive accessory coupled to the output spindle, the guard assembly including:

a guard shell being associated with a first surface of the abrasive accessory and secured to the power tool around an output spindle of the power tool;

a guard cover being associated with a second surface of the abrasive accessory opposite the first surface and attached to the guard shell at a pivot point having an axis that is at a distance from an axis of the spindle, the guard cover being rotatably movable with respect to the guard shell around the pivot point; and a latch assembly arranged to secure the guard cover to the guard shell in the closed position, the latch assembly comprising a latch housing disposed on the guard cover, a latch engaging the latch housing, a slot in the guard shell selectively engageable by the latch, a spring disposed between the latch and the latch housing to bias the latch inside the slot in the closed position, and an actuator member arranged to disengage the latch from the slot against the force of the spring, wherein in the closed position, the guard shell and the guard cover are configured to cover approximately half or more of the first and second surface of the abrasive accessory respectively, and in the open position, the guard shell covers approximately half or more of the first surface of the abrasive accessory but the guard cover covers less than half of the second surface of the abrasive accessory.

15. The power tool of claim 14, further comprising:

a field case housing the electric motor and having a motor spindle; and a gear case attached to an end of the field case and housing a gearset driven by the motor spindle, the gearset supporting the output spindle to rotate with the motor spindle.

16. The power tool of claim 14, wherein the power tool comprises at least one of a small angle grinder, a large angle grinder, or a saw.

17. The power tool of claim 14, wherein the guard shell comprises a guard collar configured to lock around a tool collar of the power tool located around the output spindle of the power tool.

18. The power tool of claim 14, wherein the pivot point comprises a rivet rotatably attaching the guard cover to the guard shell, the rivet being located near an outer periphery of the guard shell.

19. The power tool of claim 14, wherein the guard shell includes an outer circumferential portion that covers approximately half or more of a peripheral edge of the abrasive accessory, and the guard cover covers the outer circumferential portion of the guard shell in the closed position but is radially separated from the outer circumferential portion of the guard shell in the open position.

20. The power tool of claim 14, wherein the guard assembly further comprises an outer guard secured to the guard cover at a second pivot point along or in close proximity to an axis of the spindle, the outer guard being rotatably movable with respect to the guard cover around the second pivot point between: i) a retracted position, wherein the outer guard, the guard cover, and the guard shell together cover a first angular area of the abrasive accessory, and ii) an extended position, wherein the outer guard, the guard cover, and the guard shell together cover a second angular area of the abrasive accessory larger than the first angular area.

21. The power tool of claim 20, wherein the guard assembly further comprises a lock assembly disposed on an outer periphery of the outer guard and configured to secure an angular position of the outer guard with respect to the guard cover.

22. The power tool of claim 21, wherein the guard cover comprises a plurality of spaced-apart peripheral slots engageable by the lock assembly to angularly secure the outer guard to the guard cover.

* * * * *